US011603847B2

(12) United States Patent
Goldenberg et al.

(10) Patent No.: US 11,603,847 B2
(45) Date of Patent: Mar. 14, 2023

(54) CENTRIFUGAL COMPRESSOR WITH RECIRCULATION STRUCTURE

(71) Applicant: DAIKIN INDUSTRIES, LTD., Osaka (JP)

(72) Inventors: Vladislav Goldenberg, Plymouth, MN (US); Marc Phothiboupha, Brooklyn Park, MN (US)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/665,884

(22) Filed: Feb. 7, 2022

(65) Prior Publication Data

US 2022/0154721 A1 May 19, 2022

Related U.S. Application Data

(63) Continuation of application No. 15/728,815, filed on Oct. 10, 2017, now Pat. No. 11,268,523.

(51) Int. Cl.
*F04D 17/10* (2006.01)
*F04D 29/42* (2006.01)
(Continued)

(52) U.S. Cl.
CPC ..... *F04D 17/10* (2013.01); *F04D 27/0238* (2013.01); *F04D 29/4206* (2013.01);
(Continued)

(58) Field of Classification Search
CPC .. F04D 27/009; F04D 27/002; F04D 27/0246; F04D 27/684; F04D 17/10;
(Continued)

(56) References Cited

U.S. PATENT DOCUMENTS 2,405,282 A 8/1946 Birmann
2,656,096 A 10/1953 Schwarz
(Continued)

FOREIGN PATENT DOCUMENTS

DE 198 23 274 C1 10/1999
DE 10 2014 223 845 A1 5/2016
(Continued)

OTHER PUBLICATIONS

International Search Report for the corresponding international application No. PCT/US2018/054314, dated Feb. 1, 2019.
(Continued)

*Primary Examiner* — Courtney D Heinle
*Assistant Examiner* — Andrew J Marien
(74) *Attorney, Agent, or Firm* — Global IP Counselors, LLP

(57) ABSTRACT

A centrifugal compressor for a chiller system includes a casing having an inlet portion and an outlet portion, a recirculation structure including a recirculation path and a recirculation discharge cavity, an impeller disposed downstream of the recirculation discharge cavity, a plurality of recirculation discharge guide vanes disposed to surround the recirculation discharge cavity, and a diffuser disposed in the outlet portion downstream of the impeller. The recirculation structure is configured to impart a swirl to a flow of refrigerant into the inlet portion. The recirculation path supplies the refrigerant from the diffuser to the recirculation discharge cavity. The recirculation path includes a recirculation pipe that introduces the refrigerant toward the plurality of recirculation discharge guide vanes. An annular groove is disposed between the recirculation pipe and the plurality of recirculation discharge guide vanes. An annular plate is disposed between the annular groove and the recirculation discharge cavity.

12 Claims, 17 Drawing Sheets

(51) Int. Cl.

| | |
|---|---|
| ***F04D 29/44*** | (2006.01) |
| ***F25B 31/02*** | (2006.01) |
| ***F04D 29/68*** | (2006.01) |
| ***F04D 29/46*** | (2006.01) |
| ***F04D 27/02*** | (2006.01) |

(52) U.S. Cl.
CPC ..... *F04D 29/4213* (2013.01); *F04D 29/442* (2013.01); *F04D 29/462* (2013.01); *F04D 29/464* (2013.01); *F04D 29/685* (2013.01); *F25B 31/026* (2013.01); *F05D 2250/51* (2013.01); *F05D 2260/14* (2013.01); *F25B 2500/06* (2013.01); *F25B 2600/023* (2013.01)

(58) Field of Classification Search
CPC ..... F04D 27/0238; F04D 29/4213; F04D 29/462; F04D 29/464; F04D 29/4206; F04D 29/442; F04D 29/685; F25B 31/026; F25B 2600/023; F05D 2250/51
USPC ..... 415/57.1–57.2, 57.4, 58.1–58.4
See application file for complete search history.

(56) References Cited

U.S. PATENT DOCUMENTS

| | | | |
|---|---|---|---|
| 4,248,055 | A | 2/1981 | Day, III et al. |
| 4,375,939 | A | 3/1983 | Mount et al. |
| 5,059,091 | A | 10/1991 | Hatfield |
| 5,807,071 | A | 9/1998 | Brasz et al. |
| 6,672,826 | B2 | 1/2004 | LeDuc |
| 6,813,887 | B2 | 11/2004 | Sumser et al. |
| 7,150,151 | B2 | 12/2006 | Mulloy et al. |
| 8,021,104 | B2 | 9/2011 | Gu et al. |
| 8,287,232 | B2 | 10/2012 | Gu et al. |
| 10,132,324 | B2 | 11/2018 | Anschel et al. |
| 2002/0004004 | A1 | 1/2002 | Fledersbacher et al. |
| 2007/0269308 | A1 | 11/2007 | Wood |
| 2007/0271921 | A1 | 11/2007 | Chen |
| 2008/0115527 | A1 | 5/2008 | Doty et al. |
| 2009/0013689 | A1 | 1/2009 | Sumser et al. |
| 2009/0205360 | A1 | 8/2009 | Haley et al. |
| 2009/0263234 | A1 | 10/2009 | Yin |
| 2010/0043761 | A1 | 2/2010 | Joergl et al. |
| 2010/0239410 | A1 | 9/2010 | Nikpour |
| 2013/0180272 | A1 | 7/2013 | Ono et al. |
| 2013/0189074 | A1 | 7/2013 | Chen et al. |
| 2014/0056696 | A1 | 2/2014 | Kawano et al. |
| 2014/0208788 | A1 | 7/2014 | Brasz et al. |
| 2014/0308110 | A1 | 10/2014 | Houst et al. |
| 2015/0037141 | A1 | 2/2015 | Gerard et al. |
| 2015/0192147 | A1 | 7/2015 | An et al. |
| 2016/0201693 | A1 | 7/2016 | An et al. |

FOREIGN PATENT DOCUMENTS

| | | | |
|---|---|---|---|
| DE | 10 2015 111 462 | B3 | 9/2016 |
| EP | 2 110 557 | A1 | 10/2009 |
| JP | 2008-309029 | A | 12/2008 |
| JP | 2016-160760 | A | 9/2016 |
| KR | 10-0814649 | B1 | 3/2008 |

OTHER PUBLICATIONS

International Preliminary Report on Patentability including Written Opinion for the corrersponding international application No. PCT/US2018/054314, dated Apr. 14, 2020.

FULLY OPEN

50% OPEN

FULLY CLOSED

CENTRIFUGAL COMPRESSOR WITH RECIRCULATION STRUCTURE

CROSS-REFERENCE TO RELATED APPLICATION

This application is a continuation application of U.S. patent application Ser. No. 15/728,815, filed Oct. 10, 2017. The entire disclosure of U.S. patent application Ser. No. 15/728,815 is hereby incorporated herein by reference.

BACKGROUND

Field of the Invention

The present invention generally relates to a centrifugal compressor in a chiller system. More specifically, the present invention relates to a centrifugal compressor with a recirculation structure of refrigerant.

Background Information

A chiller system is a refrigerating machine or apparatus that removes heat from a medium. Commonly a liquid such as water is used as the medium and the chiller system operates in a vapor-compression refrigeration cycle. This liquid can then be circulated through a heat exchanger to cool air or equipment as required. As a necessary byproduct, refrigeration creates waste heat that must be exhausted to ambient or, for greater efficiency, recovered for heating purposes. A conventional chiller system often utilizes a centrifugal compressor, which is often referred to as a turbo compressor. Thus, such chiller systems can be referred to as turbo chillers. Alternatively, other types of compressors, e.g. a screw compressor, can be utilized.

In a conventional (turbo) chiller, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the medium (liquid) to the refrigerant, and the liquid is chilled. The refrigerant from the evaporator is then returned to the centrifugal compressor and the cycle is repeated. The liquid utilized is often water.

A conventional centrifugal compressor basically includes a casing, an inlet guide vane, an impeller, a diffuser, a motor, various sensors and a controller. Refrigerant flows in order through the inlet guide vane, the impeller and the diffuser. Thus, the inlet guide vane is coupled to a gas intake port of the centrifugal compressor while the diffuser is coupled to a gas outlet port of the impeller. The inlet guide vane controls the flow rate of refrigerant gas into the impeller. The impeller increases the velocity of refrigerant gas. The diffuser works to transform the velocity of refrigerant gas (dynamic pressure), given by the impeller, into (static) pressure. The motor rotates the impeller. The controller controls the motor, the inlet guide vane and the expansion valve. In this manner, the refrigerant is compressed in a conventional centrifugal compressor.

When the pressure next to the compressor discharge is higher than the compressor discharge pressure, the fluid tends to reverse or even flow back in the compressor. This happens when the lift pressure (condenser pressure–evaporator pressure) exceeds the compressor lift capability. This phenomenon, called surge, repeats and occurs in cycles. The compressor loses the ability to maintain its lift when surge occurs and the entire system becomes unstable. A collection of surge points during varying compressor speed or varying inlet gas angle is called a surge surface. In normal conditions, the compressor operates in the right side of the surge surface. However, during startup/operation in part load, the operating point will move towards the surge line because flow is reduced. If conditions are such that the operating point approaches the surge line, flow recirculation occurs in the impeller and diffuser. The flow separation will eventually cause a decrease in the discharge pressure, and flow from suction to discharge will resume. Surging can cause damage to the mechanical impeller/shaft system and/or to the thrust bearing due to the rotor shifting back and forth from the active to the inactive side. This is defined as the surge cycle of the compressor.

Therefore, techniques have been developed to control surge. See for example U.S. Pat. No. 4,248,055 and U.S. Patent Application Publication No. 2013/0180272.

SUMMARY OF THE INVENTION

In a centrifugal compressor, a compressor controller can control various parts to control surge. For example, the inlet guide vane and/or the discharge diffuser vane can be controlled or the speed of the compressor can be adjusted to control surge. However, these systems can limit the operation range of the compressor, and thus, can reduce performance of the compressor.

Therefore, one object of the present invention is to provide a centrifugal compressor that prevents surge without reducing performance of the compressor.

Another object of the present invention is to provide a centrifugal compressor that controls surge without overly complicated construction.

Yet another object of the present invention is to provide a centrifugal compressor that regulates a refrigerant flow while minimizing efficiency loss and allows an overall greater range of the refrigerant flow.

One or more of the above objects can basically be attained by providing a centrifugal compressor adapted to be used in a chiller system. The centrifugal compressor includes a casing having an inlet portion and an outlet portion, a recirculation structure including a recirculation path and a recirculation discharge cavity, and an impeller disposed downstream of the recirculation discharge cavity. The impeller is attached to a shaft rotatable about a shaft rotation axis. The inlet portion extends axially to the impeller. The recirculation discharge cavity is separate from and radially surrounds the inlet portion. A plurality of recirculation discharge guide vanes is disposed to surround the recirculation discharge cavity. Each of the plurality of recirculation discharge guide vanes is rotatable. A motor is arranged to rotate the shaft in order to rotate the impeller. A diffuser is disposed in the outlet portion downstream of the impeller. The recirculation structure is configured to impart a swirl to a flow of refrigerant into the inlet portion. The recirculation path supplies the refrigerant from the diffuser to the recirculation discharge cavity. The recirculation path includes a recirculation pipe that introduces the refrigerant toward the plurality of recirculation discharge guide vanes. An annular groove is disposed between the recirculation pipe and the plurality of recirculation discharge guide vanes. An annular plate is disposed between the annular groove and the recirculation discharge cavity.

One or more of the above objects can basically be attained by providing a centrifugal compressor adapted to be used in a chiller system. The centrifugal compressor includes a casing having an inlet portion and an outlet portion. The inlet portion includes an impeller. The impeller has a shaft assembly. A motor is arranged to rotate the shaft assembly in order to rotate the impeller. The outlet portion includes a diffuser and a volute assembly. A recirculation structure includes a recirculation path. The recirculation path supplies a refrigerant from the diffuser to a recirculation discharge cavity. The recirculation path includes a recirculation pipe that introduces refrigerant toward the inlet portion. A plurality of recirculation discharge guide vanes is disposed to surround the recirculation discharge cavity. An annular groove is disposed between the recirculation pipe and the plurality of recirculation discharge guide vanes. An annular plate is disposed between the annular groove and the recirculation discharge cavity.

One or more of the above objects can basically be attained by providing a centrifugal compressor adapted to be used in a chiller system. The centrifugal compressor includes a casing has an inlet portion and an outlet portion. An inlet guide vane is disposed in the inlet portion. A recirculation structure includes a recirculation pipe and a recirculation discharge cavity. An impeller is attached to a shaft. A motor is arranged to rotate the shaft in order to rotate the impeller. A plurality of recirculation discharge guide vanes. An annular groove is disposed between the recirculation pipe and the plurality of recirculation discharge guide vanes. An annular plate is disposed between the annular groove and the recirculation discharge cavity. The recirculation structure is configured and arranged to impart a swirl to a flow of refrigerant into the inlet portion. The recirculation pipe is configured to flow the refrigerant toward the plurality of recirculation discharge guide vanes.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
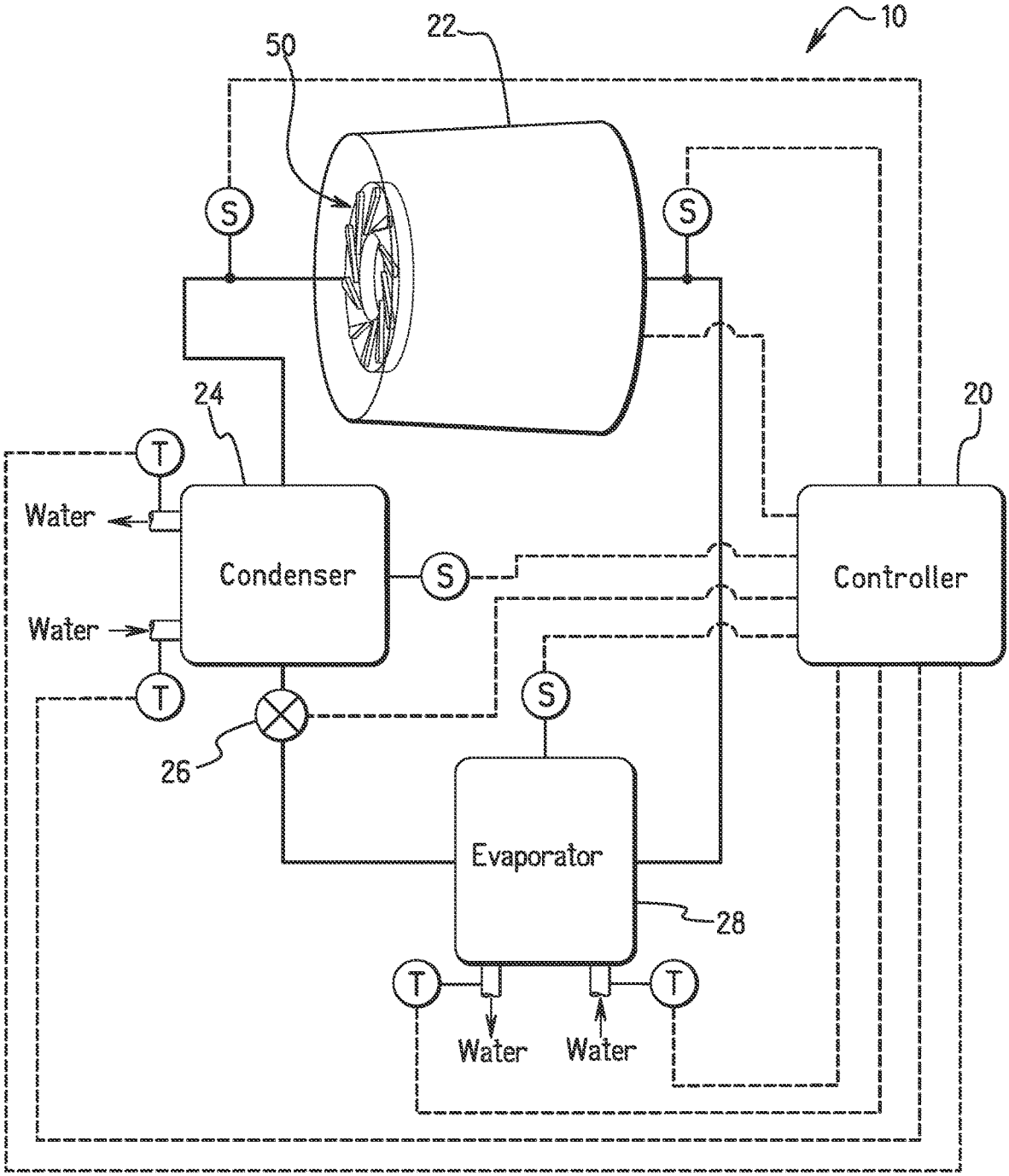
FIG. 1 is a schematic diagram illustrating a chiller system which includes a centrifugal compressor with a recirculation structure in accordance with a first embodiment of the present invention.

Referring initially to FIG. 1, a chiller system 10, which includes a compressor 22 with a recirculation structure 50, is illustrated in accordance with a first embodiment of the present invention. The chiller system 10 is preferably a water chiller that utilizes cooling water and chiller water in a conventional manner. The chiller system 10 illustrated herein is a single stage chiller system. However, it will be apparent to those skilled in the art from this disclosure that the chiller system 10 could be a multiple stage chiller system including two or more stages.

The chiller system 10 basically includes a controller 20, the compressor 22, a condenser 24, an expansion valve 26, and an evaporator 28 connected together in series to form a loop refrigeration cycle. In addition, various sensors S and T are disposed throughout the circuit of the chiller system 10 as shown in FIG. 1. The chiller system 10 is conventional except that the compressor 22 has the recirculation structure 50 in accordance with the present invention.

Figure 2A:
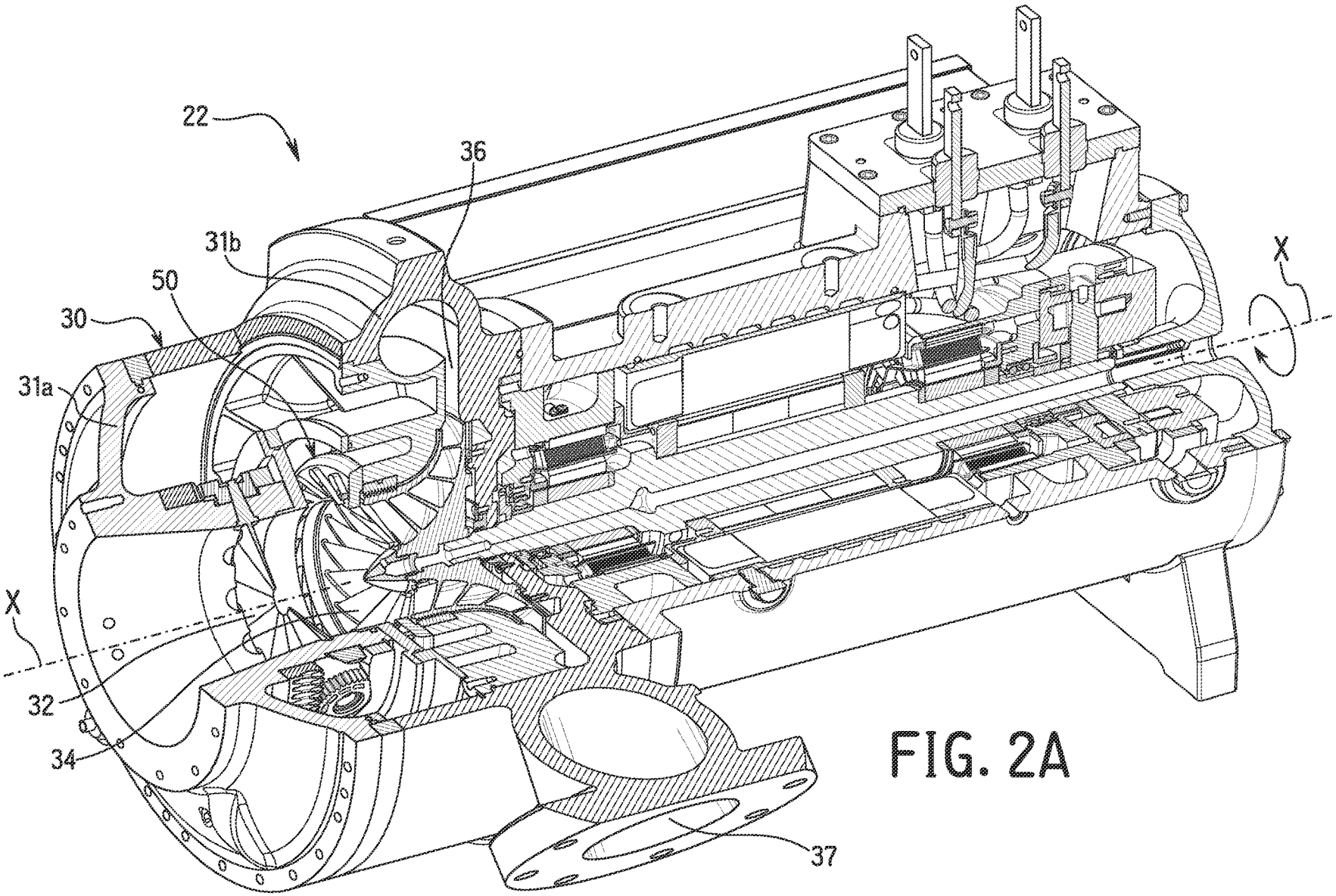
FIG. 2A is a simplified perspective view of the centrifugal compressor of the chiller system illustrated in FIG. 1, with portions broken away and shown in cross-section for the purpose of illustration.
Figure 2B:
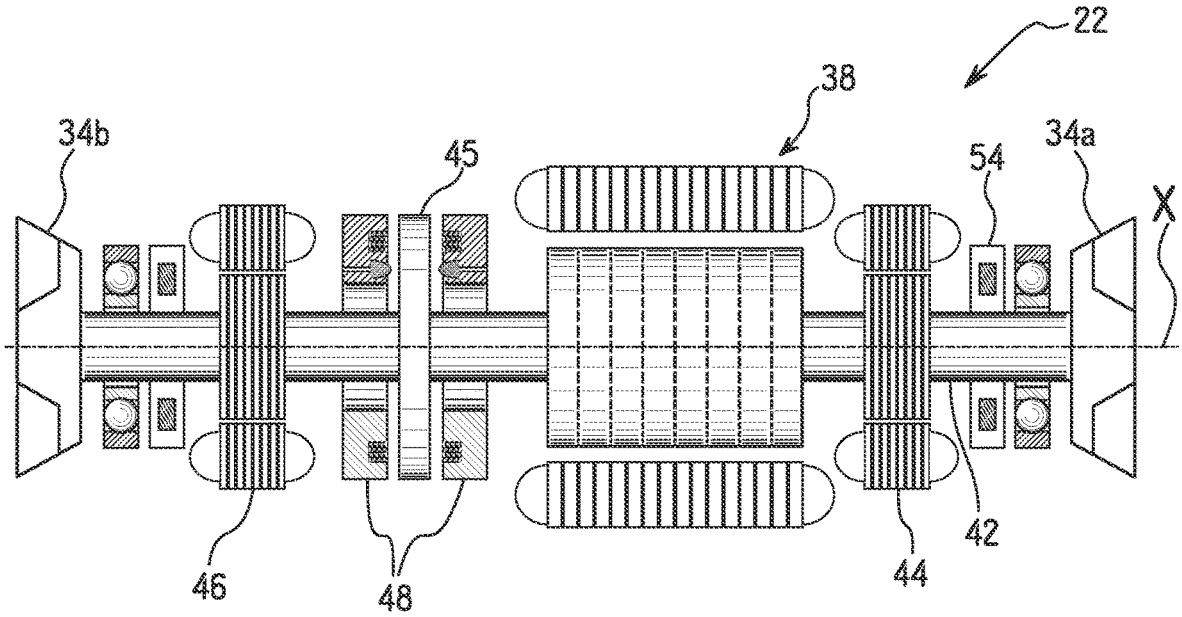
FIG. 2B is a schematic longitudinal cross-sectional view of the impeller, motor and magnetic bearing of a two-stage centrifugal compressor.
Figure 3:
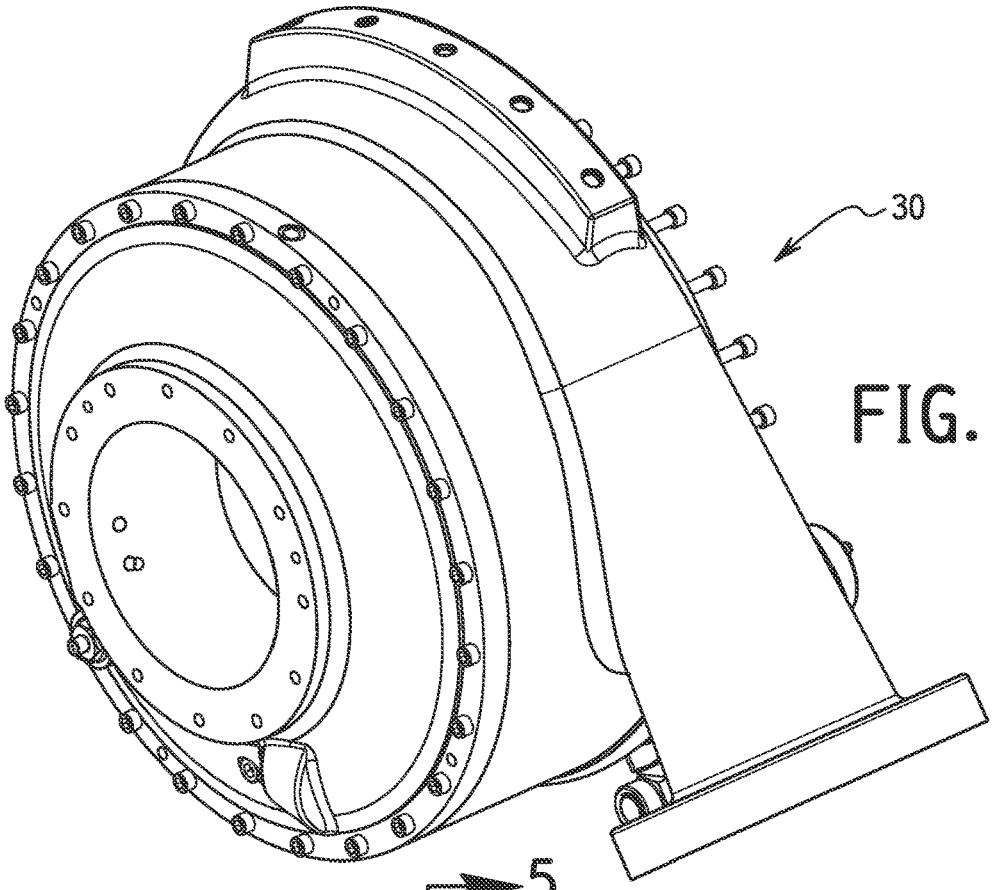
FIG. 3 is a simplified perspective view of part of the casing of the centrifugal compressor illustrated in FIG. 2A.
Figure 4:
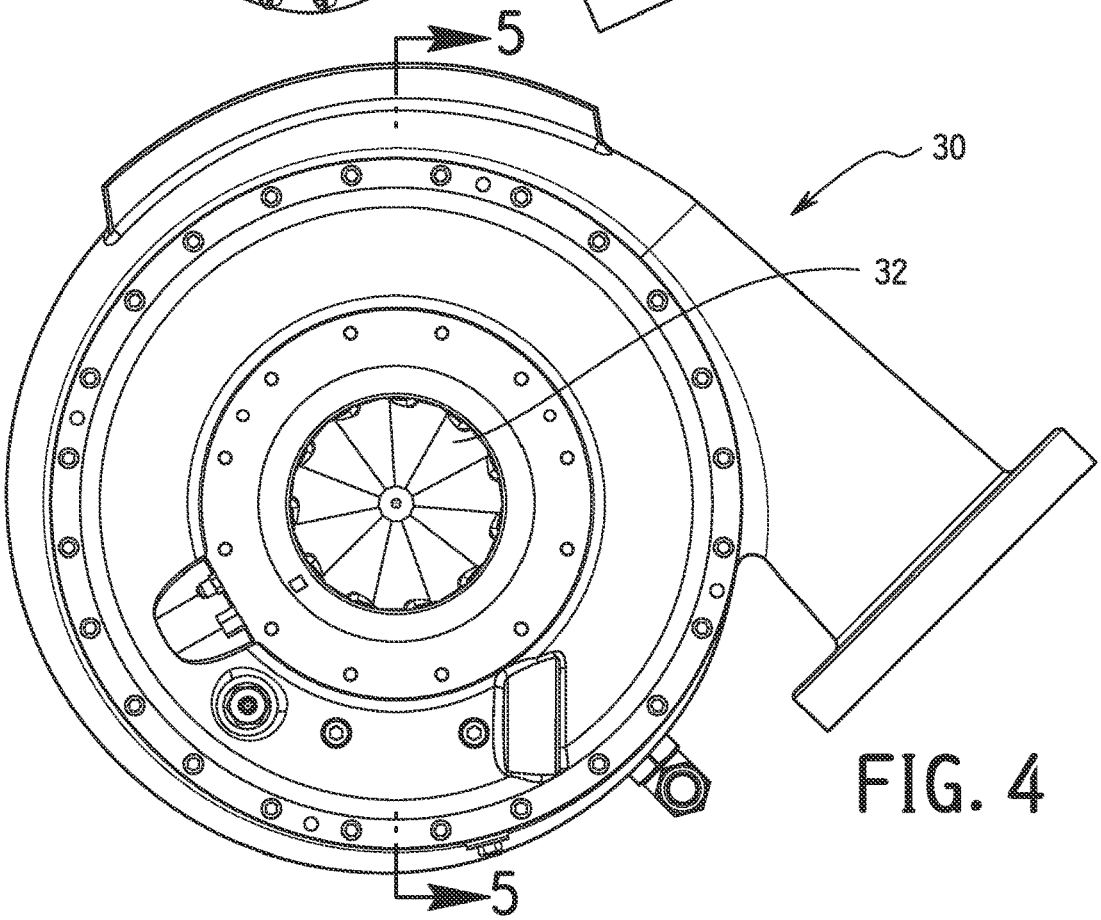
FIG. 4 is a simplified front view of the centrifugal compressor illustrated in FIGS. 2A and 3, as seen from the inlet side of the centrifugal compressor.
Figure 5:
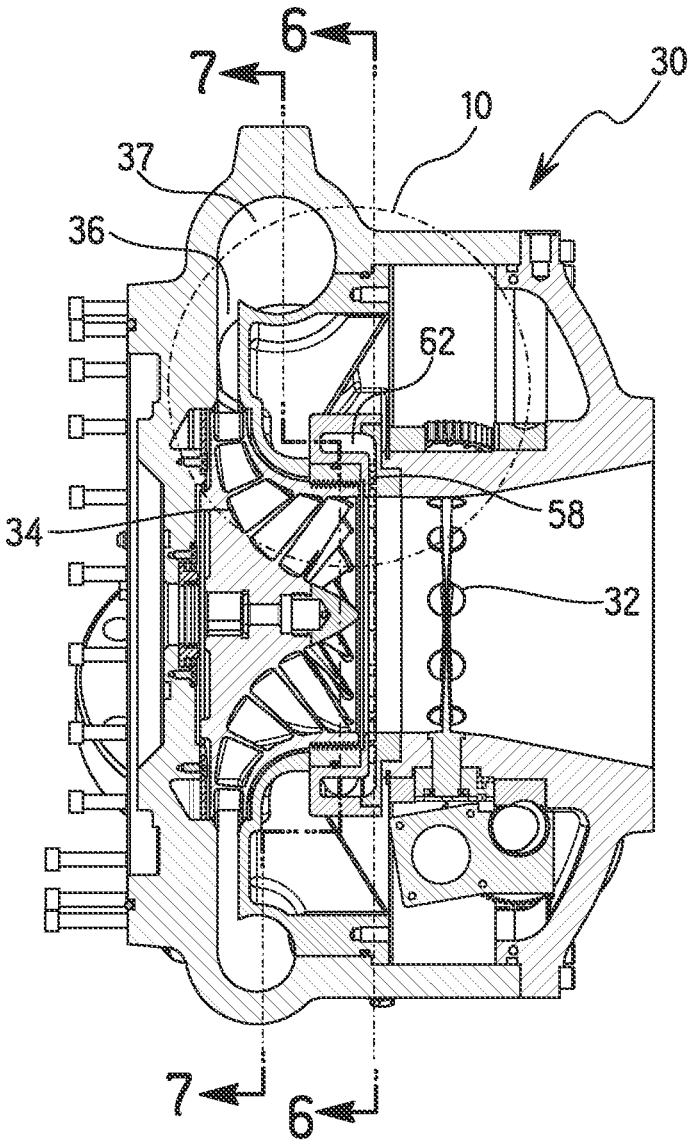
FIG. 5 is a simplified partial longitudinal cross-sectional view of the centrifugal compressor illustrated in FIGS. 2A and 4, as taken along section line 5-5 in FIG. 4.

Referring to FIGS. 1, 2A and 2B, in the illustrated embodiment, the compressor 22 is a centrifugal compressor. The centrifugal compressor 22 of the illustrated embodiment basically includes a casing 30, an optional inlet guide vane 32, an impeller 34, a diffuser/volute 36, a discharge nozzle 37, a motor 38 and a magnetic bearing assembly 40 as well as various conventional sensors. The controller 20 receives signals from the various sensors and controls the inlet guide vane 32, the motor 38 and the magnetic bearing assembly 40 in a conventional manner. Refrigerant flows in order through the inlet guide vane 32, the impeller 34 and the diffuser/volute 36. The inlet guide vane 32 controls the flow rate of refrigerant gas into the impeller 34 in a conventional manner. The impeller 34 increases the velocity of refrigerant gas. The motor speed determines the amount of increase of the velocity of refrigerant gas. The diffuser/volute 36 increases the refrigerant pressure. The motor 38 rotates the impeller 34 via a shaft 42. The magnetic bearing assembly 40 magnetically supports the shaft 42. In this manner, the refrigerant is compressed in the centrifugal compressor 22. The centrifugal compressor 22 of the illustrated embodiment includes the inlet guide vane 32. However, the inlet guide vane 32 is optional, and the recirculation structure 50 in accordance with the present invention can be applied to a centrifugal compressor which does not include an inlet guide vane.

Referring to FIG. 2B, the magnetic bearing assembly 40 is conventional, and thus, will not be discussed and/or illustrated in detail herein. Rather, it will be apparent to those skilled in the art that any suitable bearing can be used without departing from the present invention. As seen in FIG. 2B, the magnetic bearing assembly 40 preferably includes a first radial magnetic bearing 44, a second radial magnetic bearing 46 and an axial (thrust) magnetic bearing 48. In any case, at least one radial magnetic bearing 44 or 46 rotatably supports the shaft 42. The thrust magnetic bearing 48 supports the shaft 42 along a rotational axis X by acting on a thrust disk 45. The thrust magnetic bearing 48 includes the thrust disk 45 which is attached to the shaft 42.

The centrifugal compressor 22 illustrated in FIG. 2A is a single stage compressor, while the centrifugal compressor 22 illustrated in FIG. 2B is a two-stage compressor including a first stage impeller 34*a* and a second stage impeller 34*b*. As mentioned above, the recirculation structure 50 in accordance with the present invention can be applied to a single stage compressor and a multiple stage compressor including two or more stages.

Figure 17:
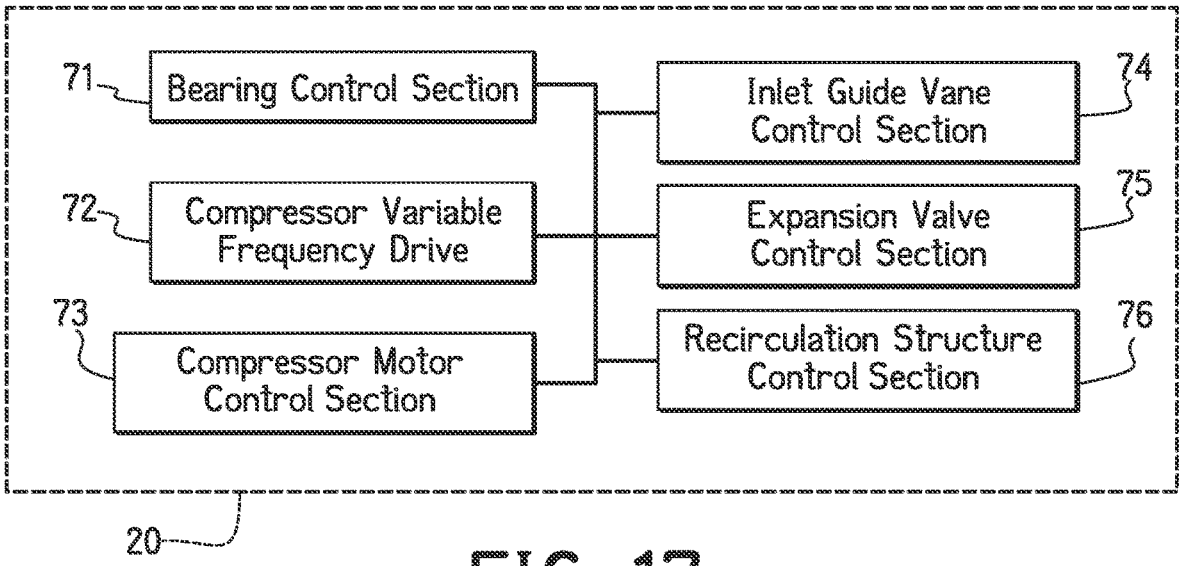
FIG. 17 is a schematic diagram illustrating the chiller controller.

Referring to FIGS. 1 and 17, the controller 20 is an electronic controller that includes a magnetic bearing control section 71, a compressor variable frequency drive 72, a compressor motor control section 73, an inlet guide vane control section 74 (optional), an expansion valve control section 75, and a recirculation structure control section 76.

In the illustrated embodiment, the control sections are sections of the controller 20 programmed to execute the control of the parts described herein. The magnetic bearing control section 71, the compressor variable frequency drive 72, the compressor motor control section 73, the inlet guide vane control section 74 (optional), the expansion valve control section 75, and the recirculation structure control section 76 are coupled to each other, and form parts of a centrifugal compressor control portion that is electrically coupled to an I/O interface of the compressor 22. However, it will be apparent to those skilled in the art from this disclosure that the precise number, location and/or structure of the control sections, portions and/or controller 20 can be changed without departing from the present invention so long as the one or more controllers are programed to execute control of the parts of the chiller system 10 as explained herein.

The controller 20 is conventional, and thus, includes at least one microprocessor or CPU, an Input/output (I/O) interface, Random Access Memory (RAM), Read Only Memory (ROM), a storage device (either temporary or permanent) forming a computer readable medium programmed to execute one or more control programs to control the chiller system 10. The controller 20 may optionally include an input interface such as a keypad to receive inputs from a user and a display device used to display various parameters to a user. The parts and programming are conventional, and thus, will not be discussed in detail herein, except as needed to understand the embodiment(s).

First Embodiment

Figure 6:
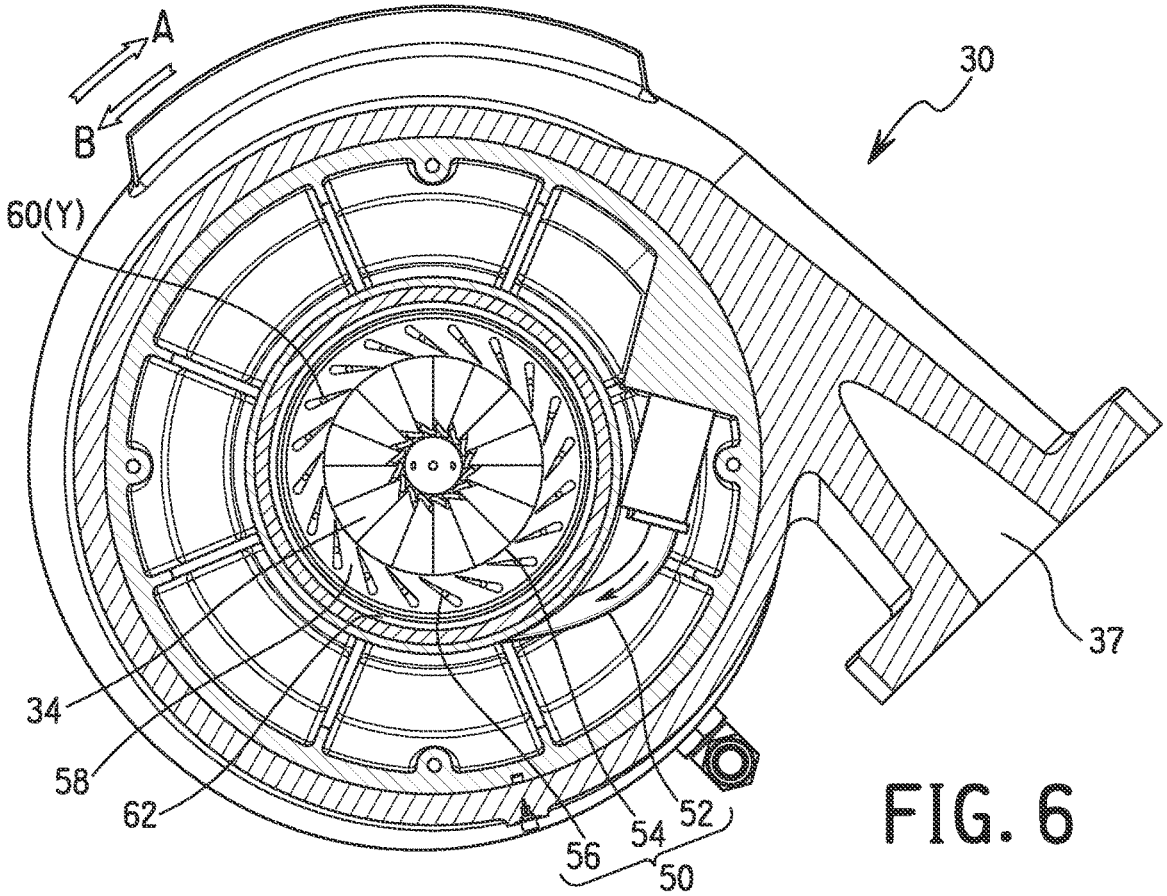
FIG. 6 is a simplified cross-sectional view of the centrifugal compressor illustrated in FIGS. 2A, 4 and 5, as taken along section line 6-6 in FIG. 5.

Referring now to FIGS. 2-10, the detailed structure of the recirculation structure 50 of the centrifugal compressor 22 according to the first embodiment will be explained. The casing 30 of the centrifugal compressor 22 has an inlet portion 31*a* and an outlet portion 31*b*. As best shown in FIG. 6, the recirculation structure 50 includes a recirculation path 52 and a recirculation discharge cavity 54. The recirculation path 52 of the recirculation structure 50 is disposed inside the casing 30 in this embodiment. The recirculation path 52 introduces refrigerant from the diffuser/volute 36 of the compressor 22, and the introduced refrigerant is discharged from the recirculation discharge cavity 54, as explained in more detail below.

As best understood from FIG. 6, a plurality of recirculation discharge guide vanes 56 are disposed to surround the recirculation discharge cavity 54. The recirculation discharge guide vanes 56 are circumferentially arranged with respect to a shaft rotation axis X of the shaft 42. The recirculation discharge guide vanes 56 are located between the inlet guide vane 32 and the impeller 34 along the direction parallel to the shaft rotation axis X. As mentioned above, however, the inlet guide vane 32 is optional, and the recirculation structure 50 in accordance with the present invention can be applied to a centrifugal compressor which does not include an inlet guide vane.

In the illustrated embodiment, the recirculation structure 50 further includes an annular plate 58. The recirculation discharge guide vanes 56 are disposed on the annular plate 58 to be spaced from each other substantially equally. Each of the recirculation discharge guide vanes 56 is rotatably attached onto the annular plate 58 using a vane shaft 60. Each of the recirculation discharge guide vanes 56 is connected to a rotating mechanism (not shown) which rotates each of the recirculation discharge guide vanes 56. The rotating mechanism is conventional, and thus, will not be discussed and/or illustrated in detail herein. Rather, it will be apparent to those skilled in the art that any suitable rotating mechanism can be used without departing from the present invention. The rotating mechanism is coupled to the recirculation structure control section 76 of the controller 20. The angle of each recirculation discharge guide vane 56 is adjustable by rotating the recirculation discharge guide vanes 56 with the rotating mechanism. The recirculation structure control section 76 of the controller 20 is configured to control the angle of each recirculation discharge guide vane 56.

Figure 8:
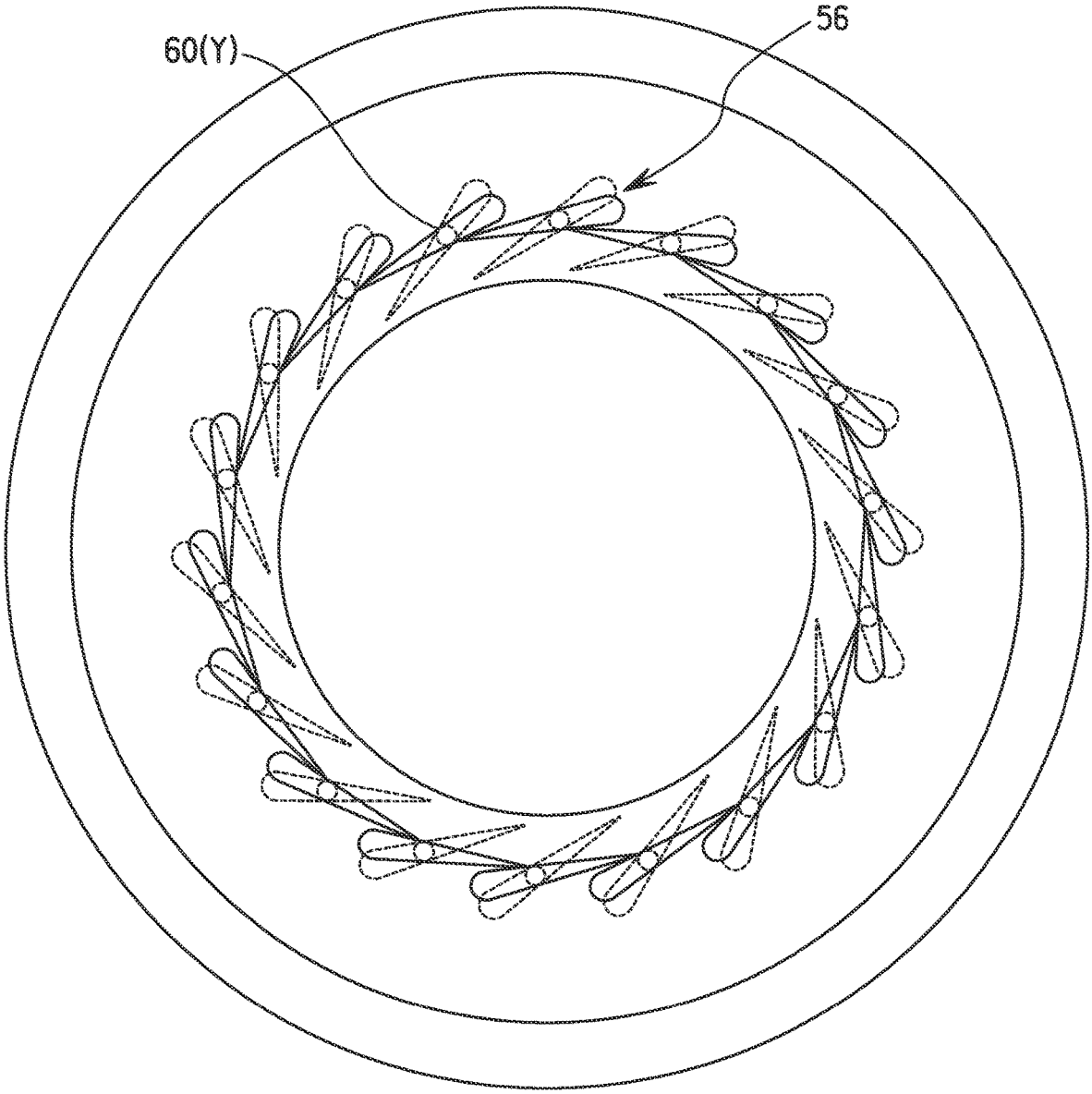
FIG. 8 is a schematic view showing the movement of recirculation discharge guide vanes of the recirculation structure.
Figure 9A:
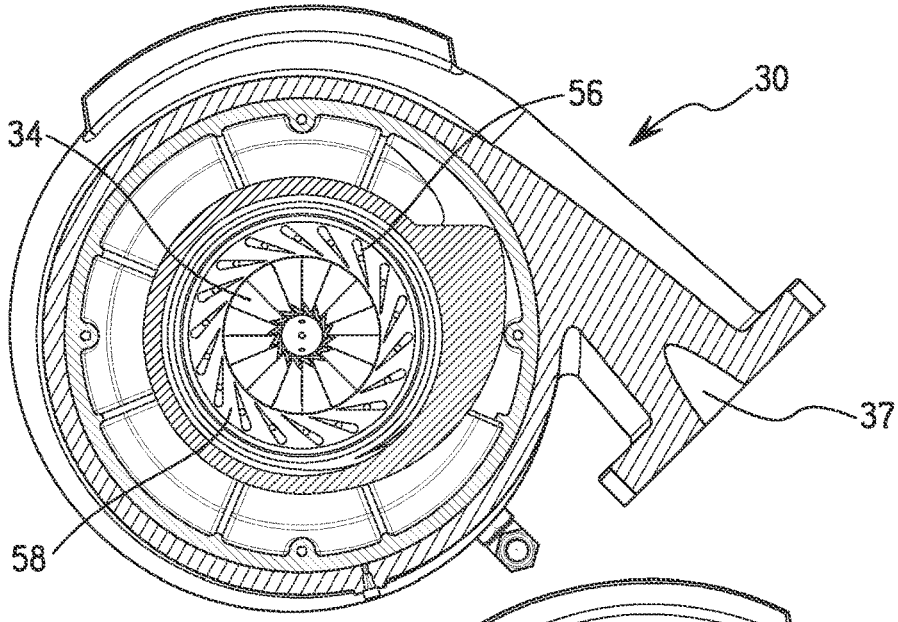
FIG. 9A is a simplified cross-sectional view of the centrifugal compressor illustrated in FIGS. 2A, 4 and 5, with the vanes of the recirculation structure being open.
Figure 9B:
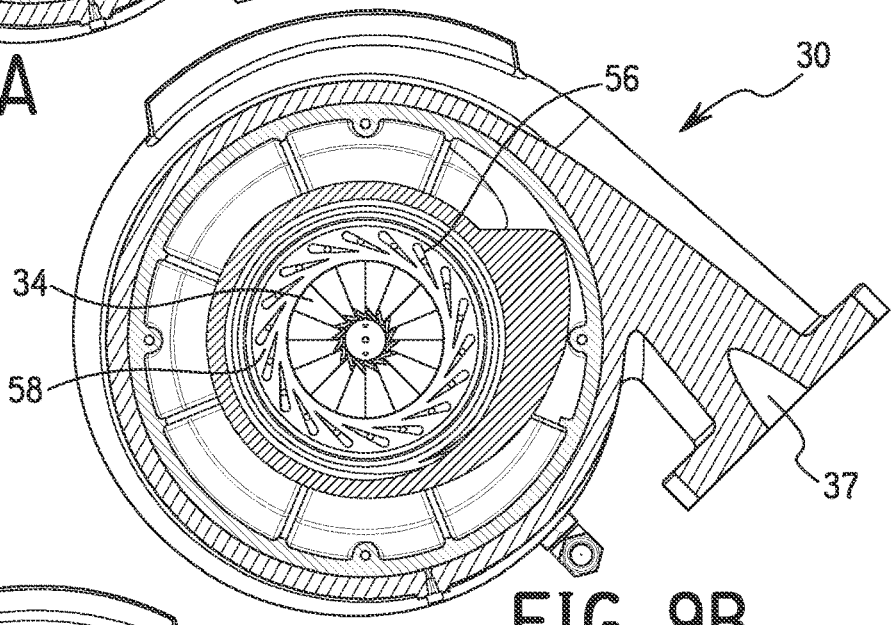
FIG. 9B is a simplified cross-sectional view of the centrifugal compressor illustrated in FIGS. 2A, 4 and 5, with the vanes of the recirculation structure being half-open.
Figure 9C:
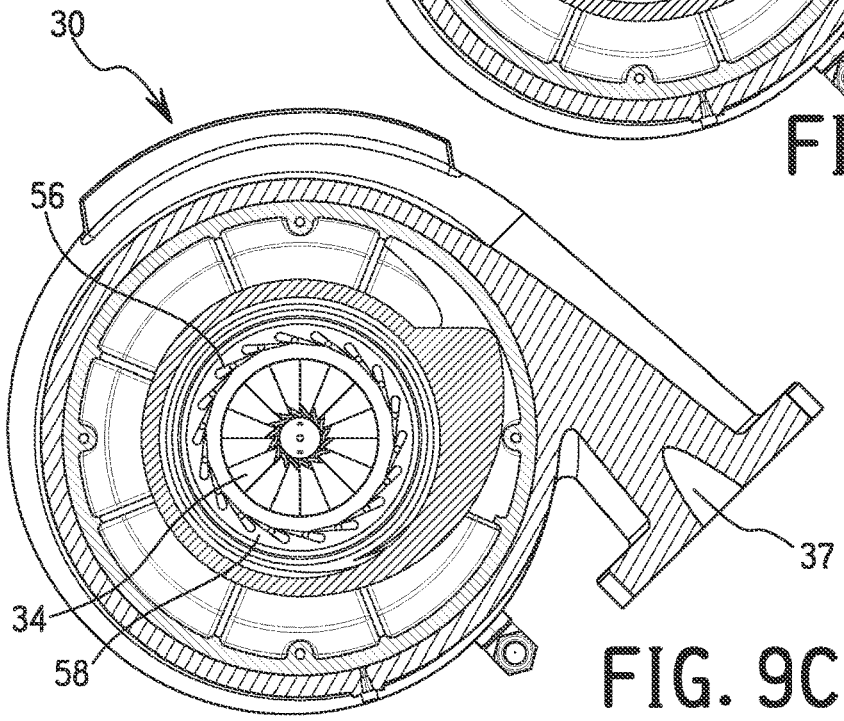
FIG. 9C is a simplified cross-sectional view of the centrifugal compressor illustrated in FIGS. 2A, 4 and 5, with the vanes of the recirculation structure being fully closed.
Figure 10:
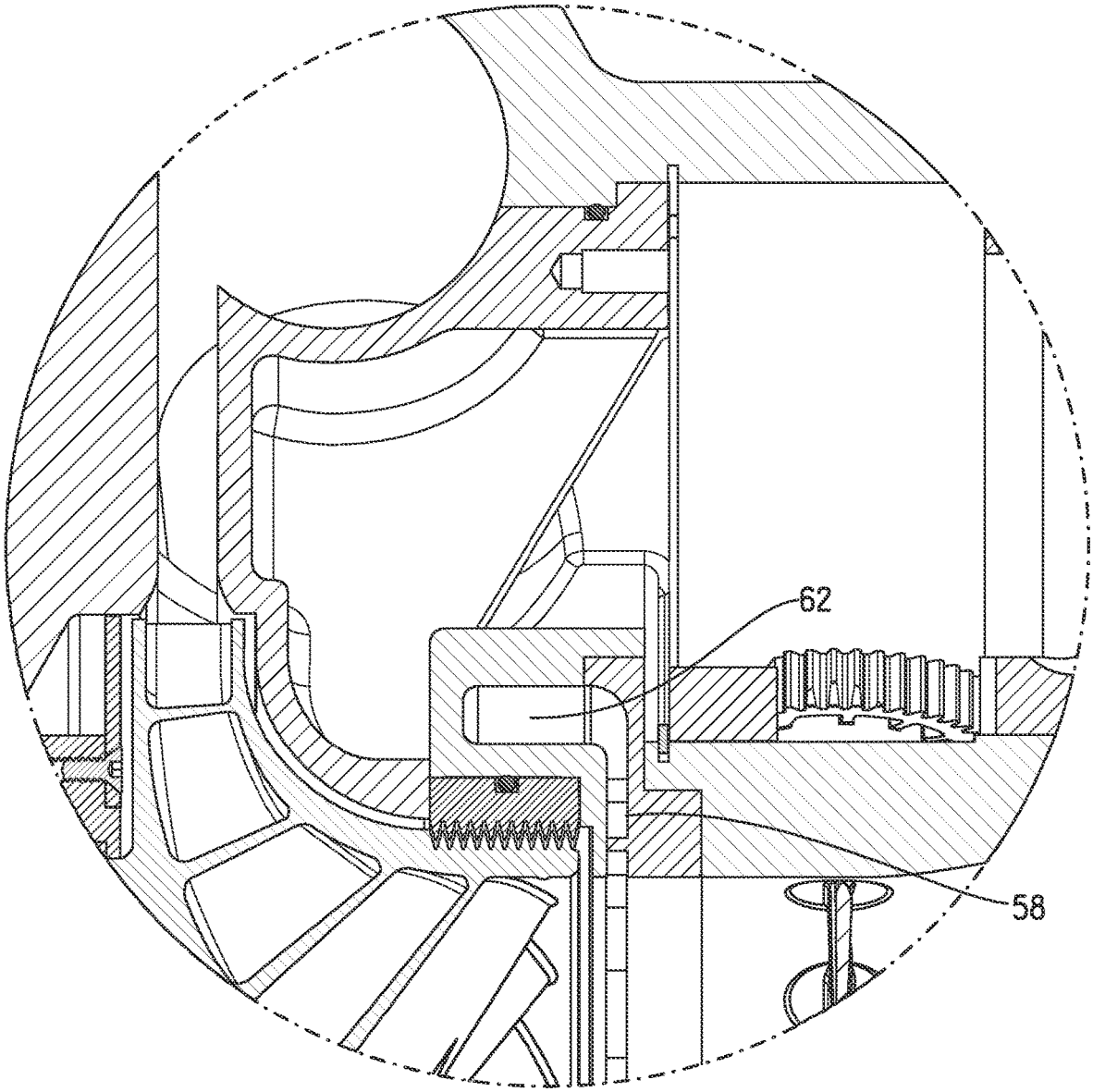
FIG. 10 is a simplified enlarged view inside circle 10 in FIG. 5.

As shown in FIG. 8, each of the recirculation discharge guide vanes 56 is rotatable about a shaft rotation axis Y of the vane shaft 60. The shaft rotation axis Y of the vane shaft 60 is substantially parallel to the shaft rotation axis X of the shaft 42. The plurality of recirculation discharge guide vanes 56 can be connected to a linking mechanism (not shown). The linking mechanism is conventional, and thus, will not be discussed and/or illustrated in detail herein. Rather, it will be apparent to those skilled in the art that any suitable linking mechanism can be used without departing from the present invention. In the illustrated embodiment, the plurality of recirculation discharge guide vanes 56 are linked with one another by the linking mechanism so that the angles of the plurality of recirculation discharge guide vanes 56 are adjusted simultaneously. For example, the angles of the plurality of recirculation discharge guide vanes 56 can be adjusted gradually from the open state as shown in FIG. 9A to the closed state as shown in FIG. 9C.

Figure 7:
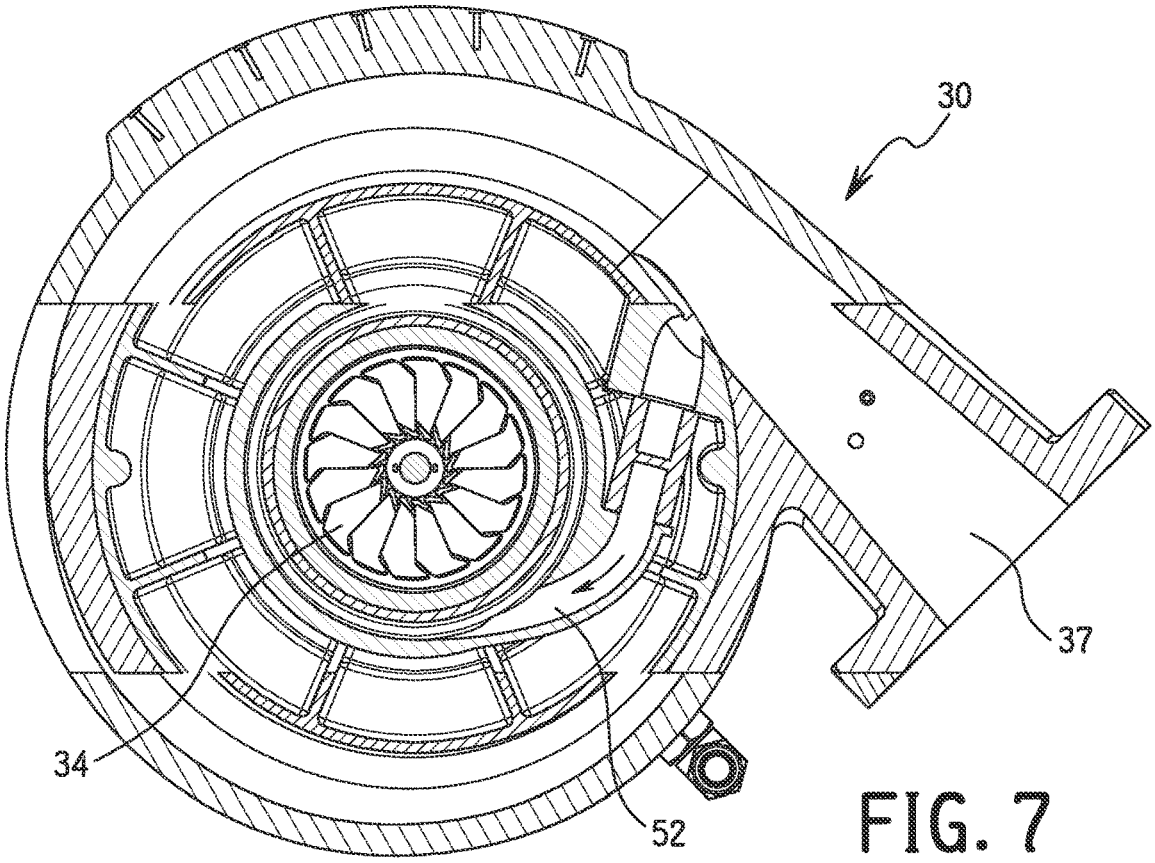
FIG. 7 is a simplified cross-sectional view of the centrifugal compressor illustrated in FIGS. 2A, 4, 5 and 6, as taken along section line 7-7 in FIG. 5.

Referring to FIGS. 6 and 7, the recirculation path 52 includes a recirculation pipe. The recirculation pipe 52 extends from the diffuser/volute 36 of the compressor 22 toward the plurality of recirculation discharge guide vanes 56 in the first embodiment. An annular groove 62 is disposed in the casing 30 to connect between the recirculation pipe 52 and the plurality of recirculation discharge guide vanes 56. The annular groove 62 extends the whole inner circumference of the casing 30. The refrigerant introduced from the diffuser/volute 36 of the compressor 22 via the recirculation pipe 52 passes through the annular groove 62 and flows toward the plurality of recirculation discharge guide vanes 56. The plurality of recirculation discharge guide vanes 56 increase the velocity of the refrigerant and create a swirl of the refrigerant. The swirl of the refrigerant is discharged from the recirculation discharge cavity 54 and mixed into the main flow of the refrigerant in the inlet portion 31*a* of the casing 31 of the compressor 22. In this manner, the recirculation structure 50 imparts a swirl to the flow of refrigerant in the inlet portion 31*a*, with the velocity of the recirculation flow caused by the swirl being higher than the velocity of the flow of the refrigerant in the inlet portion 31*a*. The recirculation flow of the refrigerant can be controlled by adjusting the angles of the recirculation discharge guide vanes 56.

Also, the direction of the recirculation flow can be controlled by adjusting the angles of the recirculation discharge guide vanes 56. More specifically, the direction of the recirculation flow can be controlled to be in the same direction as the rotation direction of the impeller 34 as shown by arrow A in FIG. 6. In this case, a significant ability to reduce the main flow of the refrigerant is predicted with minimum efficiency and pressure rise penalties. Alternatively, the direction of the recirculation flow can be controlled to be in the opposite direction to the rotation direction of the impeller 34 as shown by arrow B in FIG. 6. In this case, an increase head or pressure rise will result with a small efficiency penalty.

Second Embodiment

Referring to FIGS. 11A-11D, the recirculation structure 50 in accordance with the second embodiment will be explained.

Figure 11B:
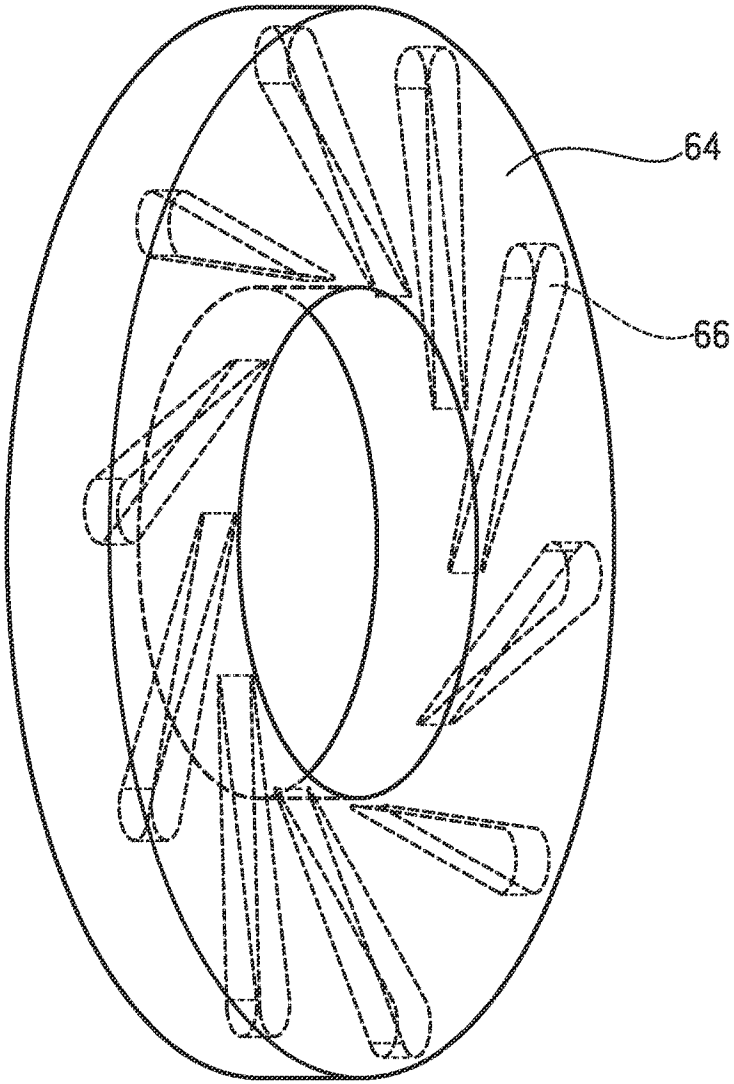
FIG. 11B is a simplified perspective view of an interlocking plate of the recirculation structure in accordance with the second embodiment of the present invention.
Figure 11A:
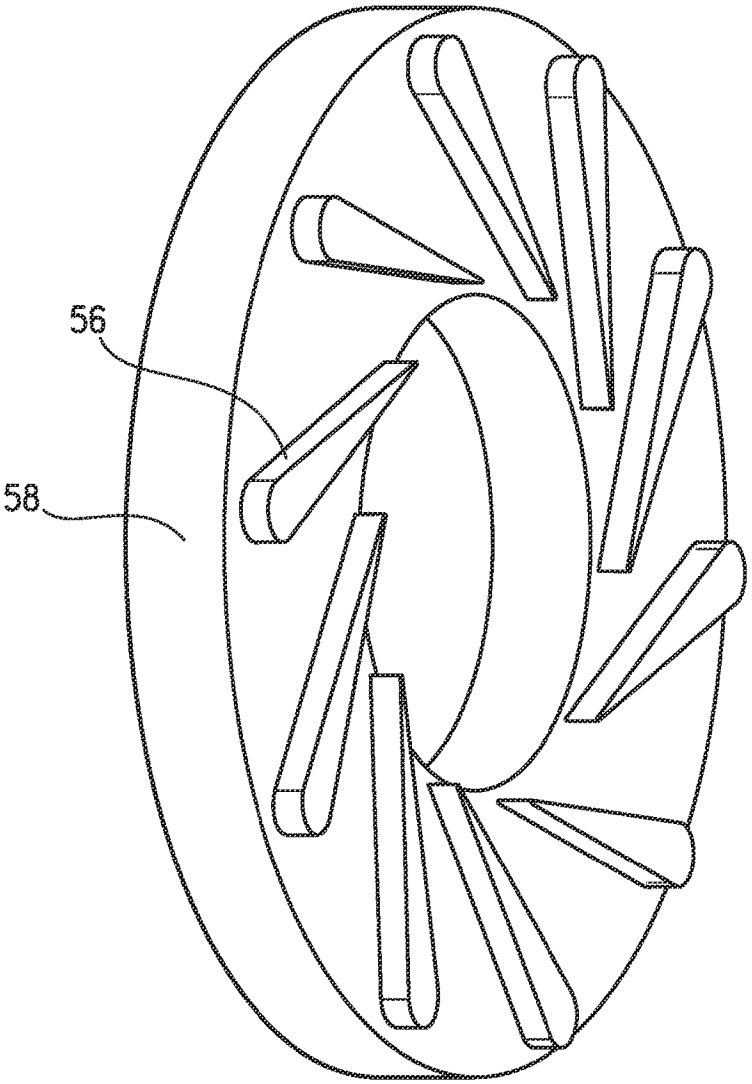
FIG. 11A is a simplified perspective view of an annular plate of a recirculation structure in accordance with a second embodiment of the present invention.

The recirculation structure 50 in the second embodiment further includes an interlocking plate 64 which has a similar shape to the annular plate 58 except that the interlocking plate 64 has a plurality of recesses 66 adapted to receive the plurality of recirculation discharge guide vanes 56 disposed on the annular plate 58 as illustrated in FIG. 11B. In the second embodiment, the recirculation discharge guide vanes 56 are fixedly attached to the annular plate 58 so as to fit properly in the recesses 66 of the interlocking plate 64. The interlocking plate 64 is connected to a linear actuator (not shown) so that the interlocking plate 64 can be moved axially along the direction parallel to the shaft rotation axis X of the shaft 42 of the motor 38. The linear actuator is conventional, and thus, will not be discussed and/or illustrated in detail herein. Rather, it will be apparent to those skilled in the art that any suitable linear actuator can be used without departing from the present invention.

Figure 11D:
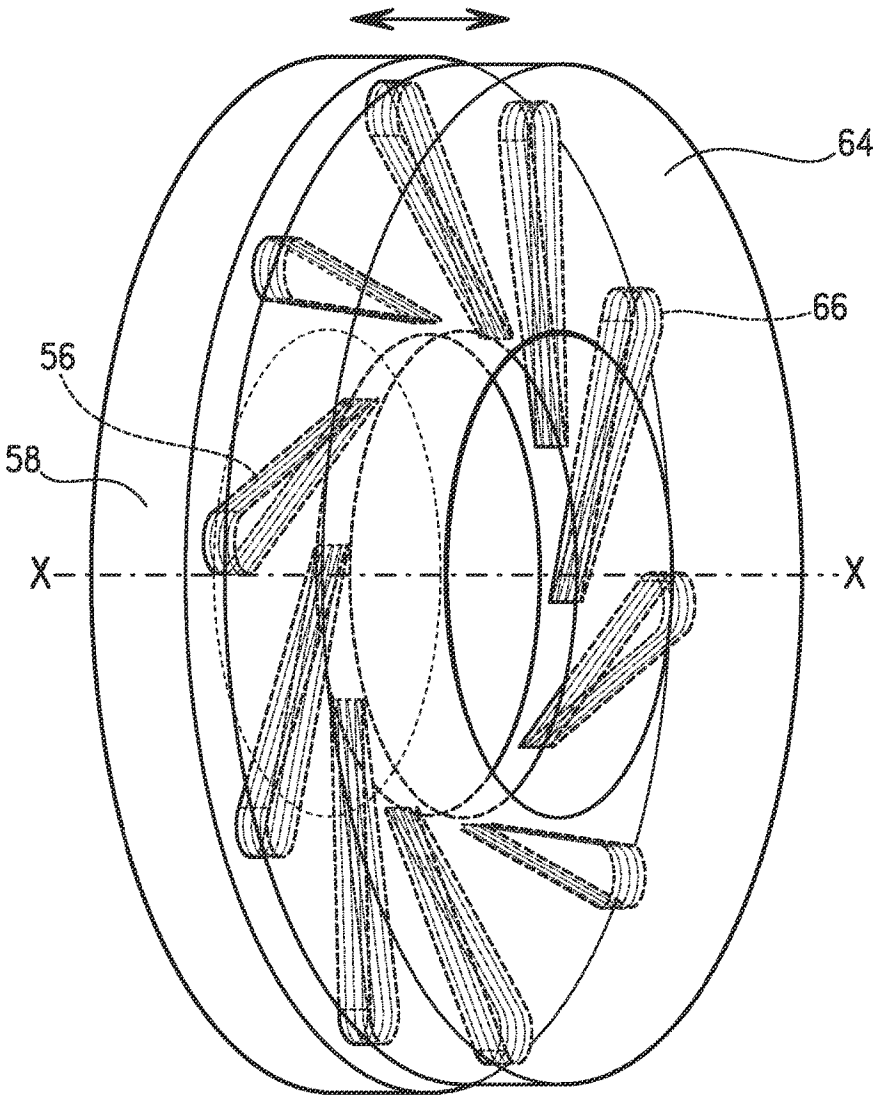
FIG. 11D is a simplified perspective view of the annular plate and the interlocking plate of the recirculation structure in accordance with the second embodiment, illustrating a state in which the annular plate and the interlocking plate are separate from each other.
Figure 11C:
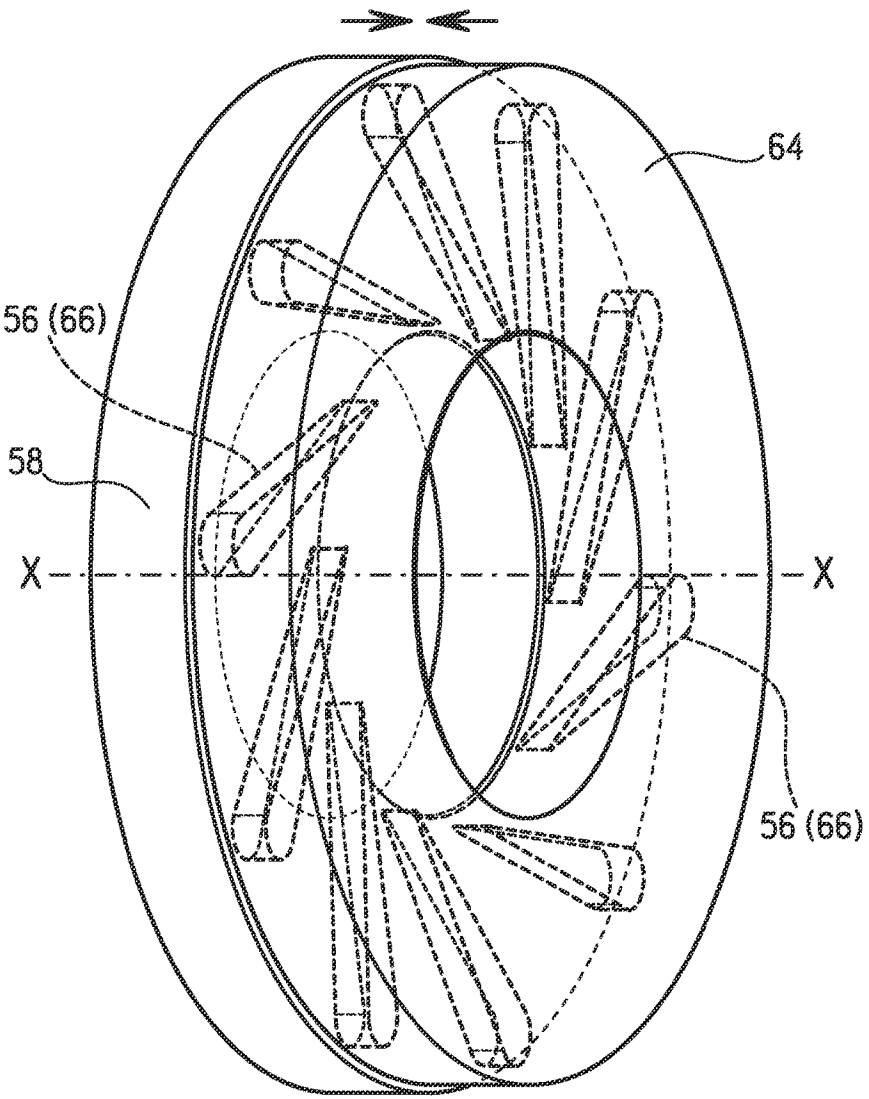
FIG. 11C is a simplified perspective view of the annular plate and the interlocking plate of a recirculation structure in accordance with the second embodiment, illustrating a state in which the annular plate and the interlocking plate are close with each other.
Figure 12:
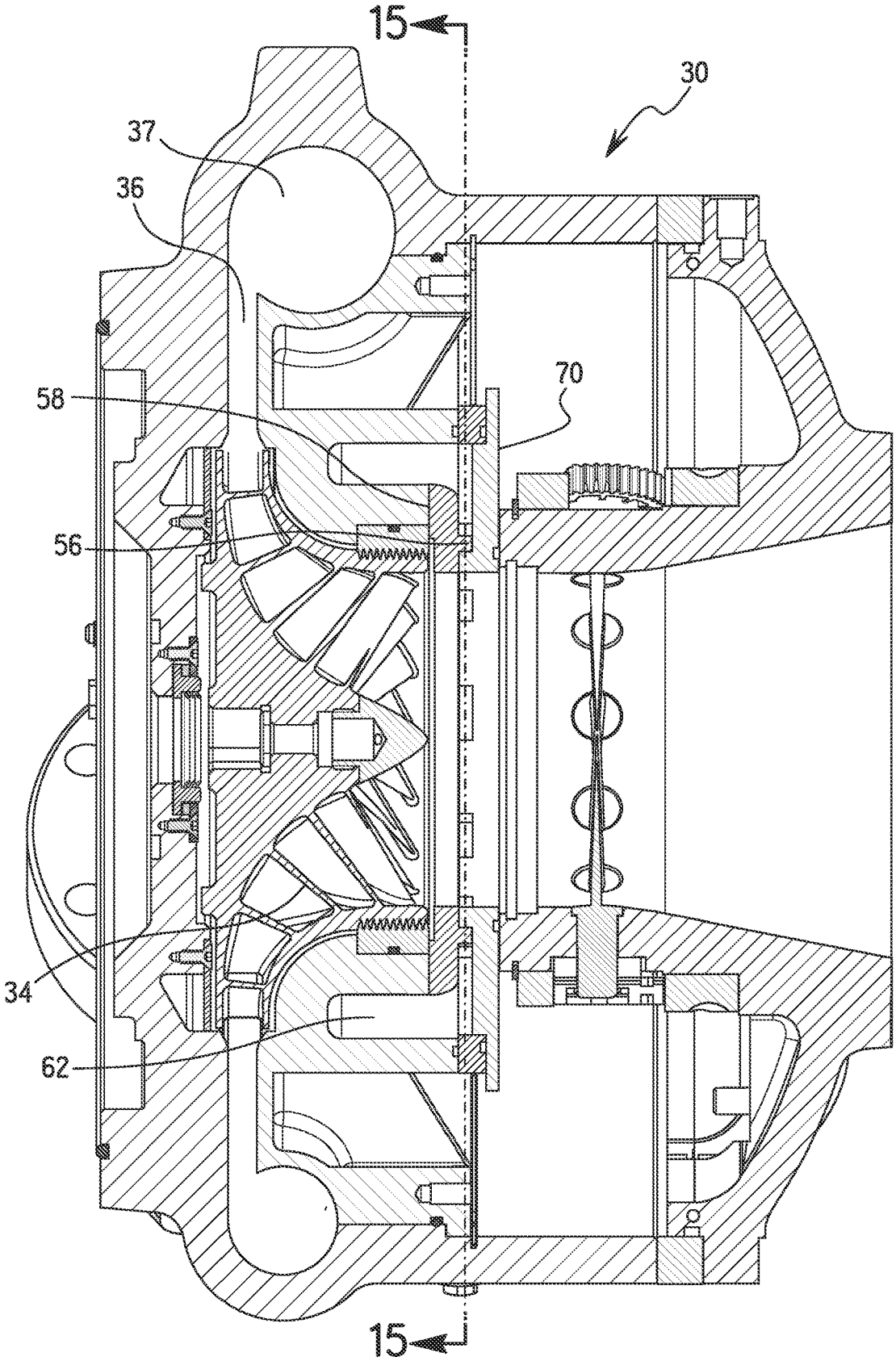
FIG. 12 is a simplified partial longitudinal cross-sectional view of the centrifugal compressor in accordance with a third embodiment of the present invention.
Figure 13:
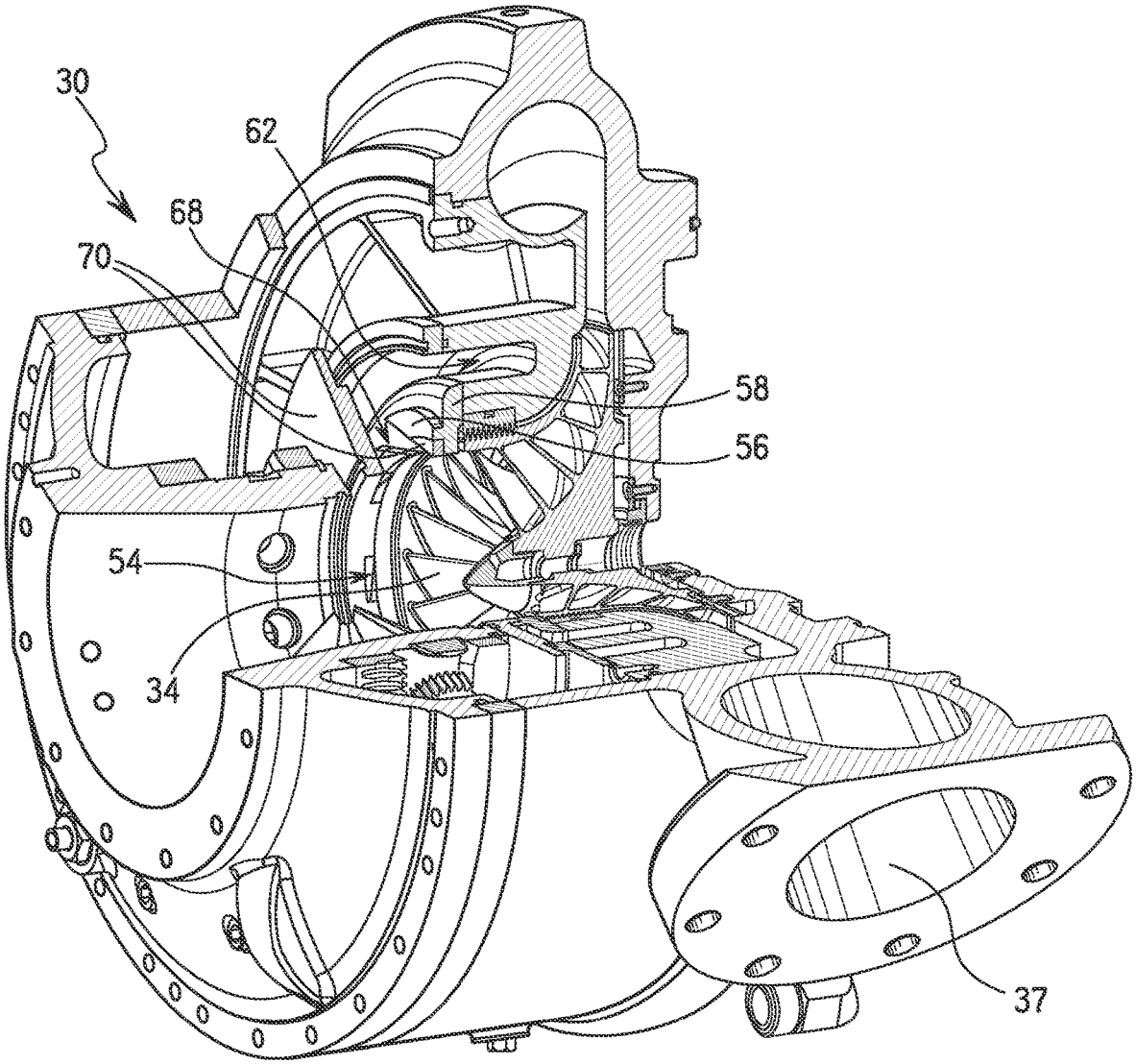
FIG. 13 is a simplified perspective view of the centrifugal compressor in accordance with the third embodiment, with portions broken away and shown in cross-section for the purpose of illustration.

As shown in FIG. 11C, the interlocking plate 64 can be moved axially in a direction where the annular plate 58 and the interlocking plate 64 are close with each other. In this close position as shown in FIG. 11C, the plurality of recesses 66 of the interlocking plate 64 receive the plurality of recirculation discharge guide vanes 56 on the annular plate 58. Also, as shown in FIG. 11D, the interlocking plate 64 can be moved axially in a direction where the annular plate 58 and the interlocking plate 64 are separate from each other. In this separate position as shown in FIG. 11D, the plurality of recirculation discharge guide vanes 56 on the annular plate 58 are released from the plurality of recesses 66 of the interlocking plate 64. This axial movement of the interlocking plate 64 allows the flow area of the recirculation flow to vary in the axial direction, and thus, the recirculation flow can be further controlled with this axial movement of the interlocking plate 64. Alternatively, the annular plate 58 may be connected to a linear actuator. In this case, the axial movement of the annular plate 58 allows the flow area of the recirculation flow to vary in the axial direction, and thus, the recirculation flow can be further controlled with this axial movement of the annular plate 58. Both of the interlocking plate 64 and the annular plate 58 can be configured to move axially.

Third Embodiment

Referring to FIGS. 12-15, the recirculation structure 50 in accordance with the third embodiment will be explained.

Figure 14A:
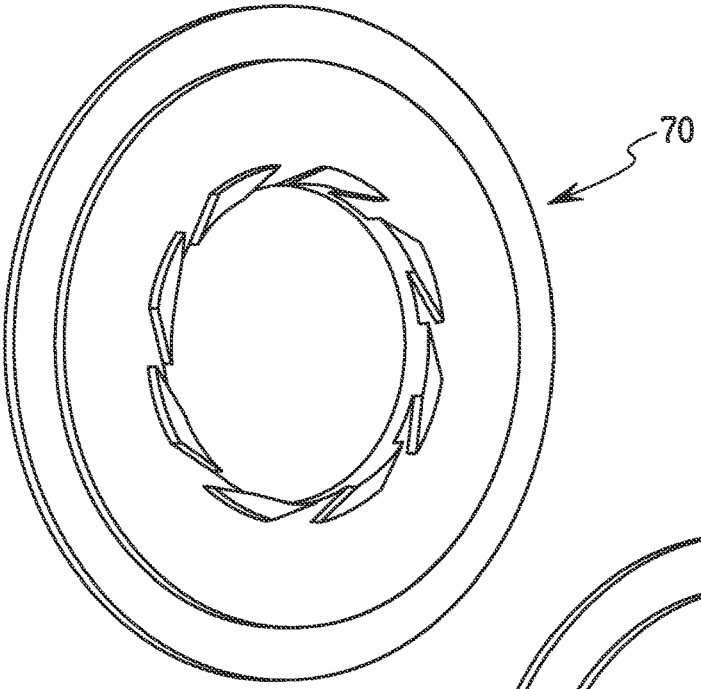
FIG. 14A is a simplified perspective view of a rotating manifold plate of the recirculation structure in accordance with the third embodiment.
Figure 14B:
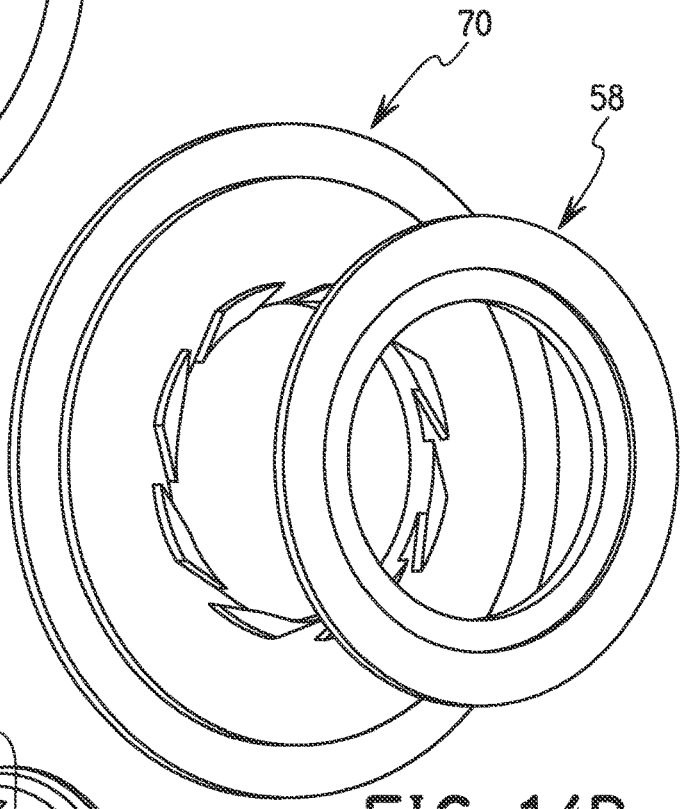
FIG. 14B is a simplified perspective view of the rotating manifold plate with an annular plate of the recirculation structure in accordance with the third embodiment.
Figure 14C:
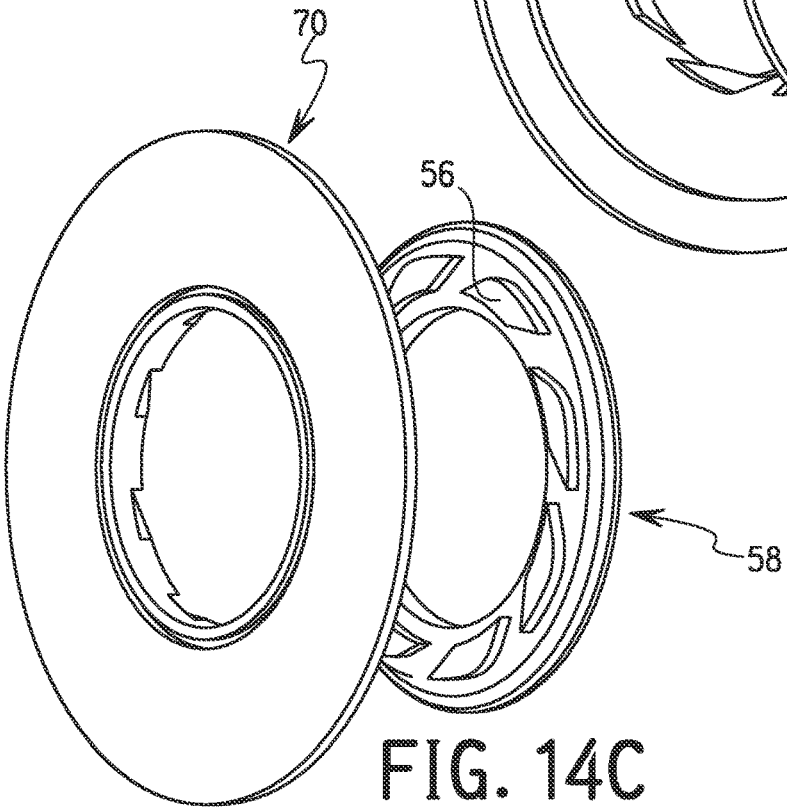
FIG. 14C is a simplified rear perspective view of the rotating manifold plate with the annular plate of the recirculation structure in accordance with the third embodiment.
Figure 15A:
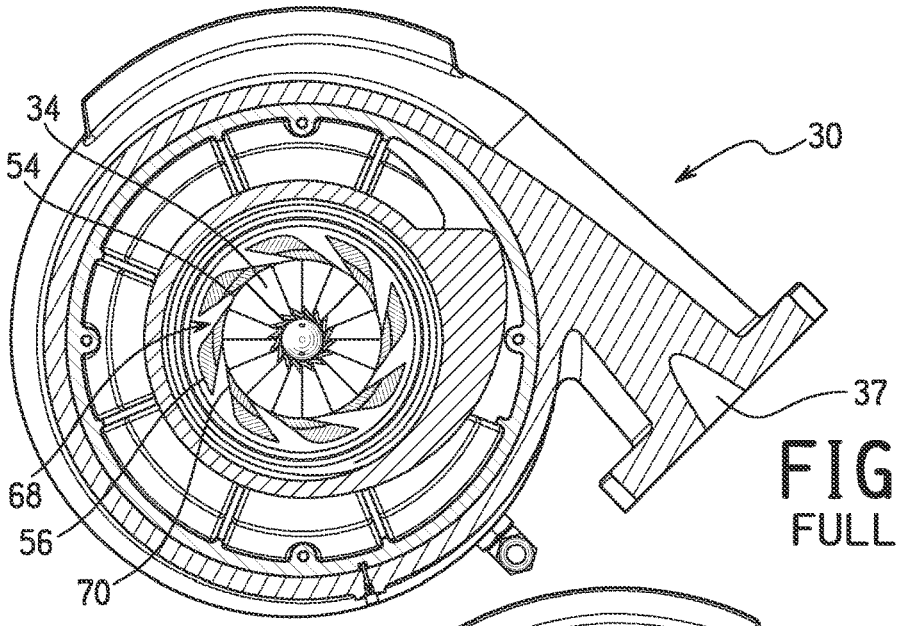
FIG. 15A is a simplified cross-sectional view of the centrifugal compressor in accordance with the third embodiment, as taken along section line 15-15 in FIG. 12, with the vanes of the recirculation structure being fully open.
Figure 15B:
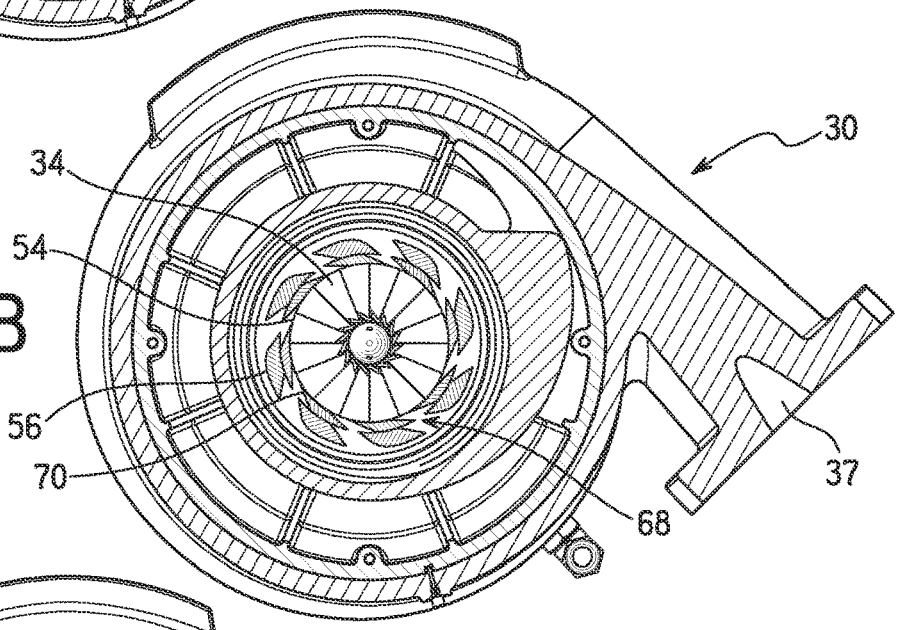
FIG. 15B is a simplified cross-sectional view of the centrifugal compressor in accordance with the third embodiment, as taken along section line 15-15 in FIG. 12, with the vanes of the recirculation structure being 50% open.
Figure 15C:
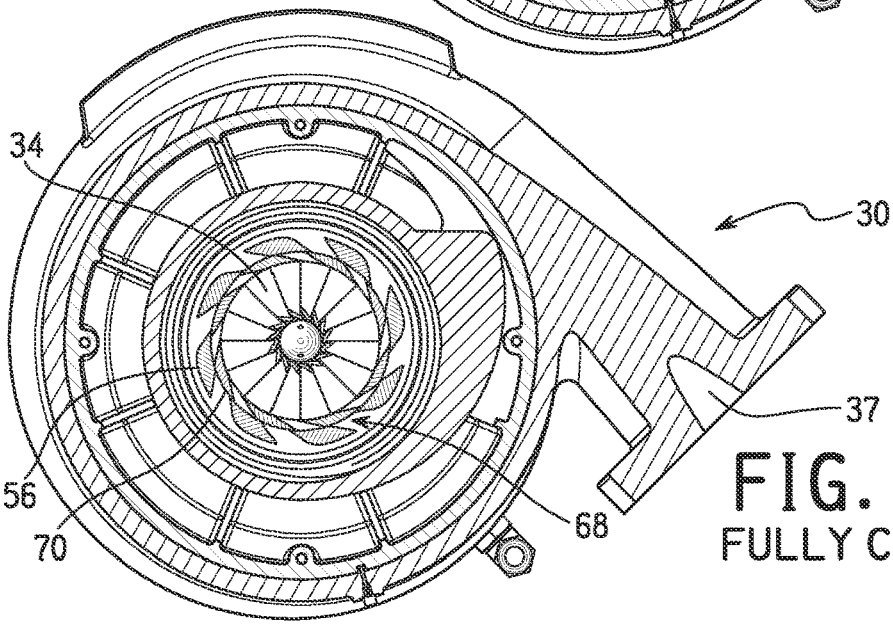
FIG. 15C is a simplified cross-sectional view of the centrifugal compressor in accordance with the third embodiment, as taken along section line 15-15 in FIG. 12, with the vanes of the recirculation structure being fully closed.

The recirculation structure 50 in the third embodiment further includes a rotating manifold plate 70 having a shape as illustrated in FIGS. 14A-14C. The plurality of recirculation discharge guide vanes 56 are attached to the annular plate 58 to be stationary in this embodiment. The plurality of recirculation discharge guide vanes 56 are disposed at a substantially same interval with each other such that channels 68 are defined between each of the plurality of recirculation discharge guide vanes 56. The plurality of recirculation discharge guide vanes 56 occupy substantially half of the flow area of the refrigerant in the radial direction as illustrated in FIGS. 15A-15C. The rotating manifold plate 70 is arranged to be rotatable about an axis which is coincident with the shaft rotation axis X of the shaft 42 of the motor 38. As the rotating manifold plate 70 rotates, the rotating manifold plate 70 closes off the channels 68 between each of the plurality of recirculation discharge guide vanes 56, as explained in more detail below.

When the rotating manifold plate 70 is in a fully open position as illustrated in FIG. 15A, the rotating manifold plate 70 aligns with the plurality of recirculation discharge guide vanes 56 in the radial direction and the channels 68 between each of the plurality of recirculation discharge guide vanes 56 are fully opened. When the rotating manifold plate 70 is in a 50% open position as illustrated in FIG. 15B, the rotating manifold plate 70 occupies 50% of the channels 68 between each of the plurality of recirculation discharge guide vanes 56. When the rotating manifold plate 70 is in a fully closed position as illustrated in FIG. 15C, the channels 68 between each of the plurality of recirculation discharge guide vanes 56 are fully closed with the rotating manifold plate 70. With this arrangement, the rotating manifold plate 70 gradually open/close the channels 68 between each of the plurality of recirculation discharge guide vanes 56. The rotation of the rotating manifold plate 70 allows the flow area of the recirculation flow to vary in the radial direction, and thus, the recirculation flow can be further controlled. In the illustrated embodiment, the rotating manifold plate 70 rotates with respect to the annular plate 58. Alternatively, the annular plate 58 can be rotated with respect to the stationary plate 70.

Modified Embodiment

Figure 16:
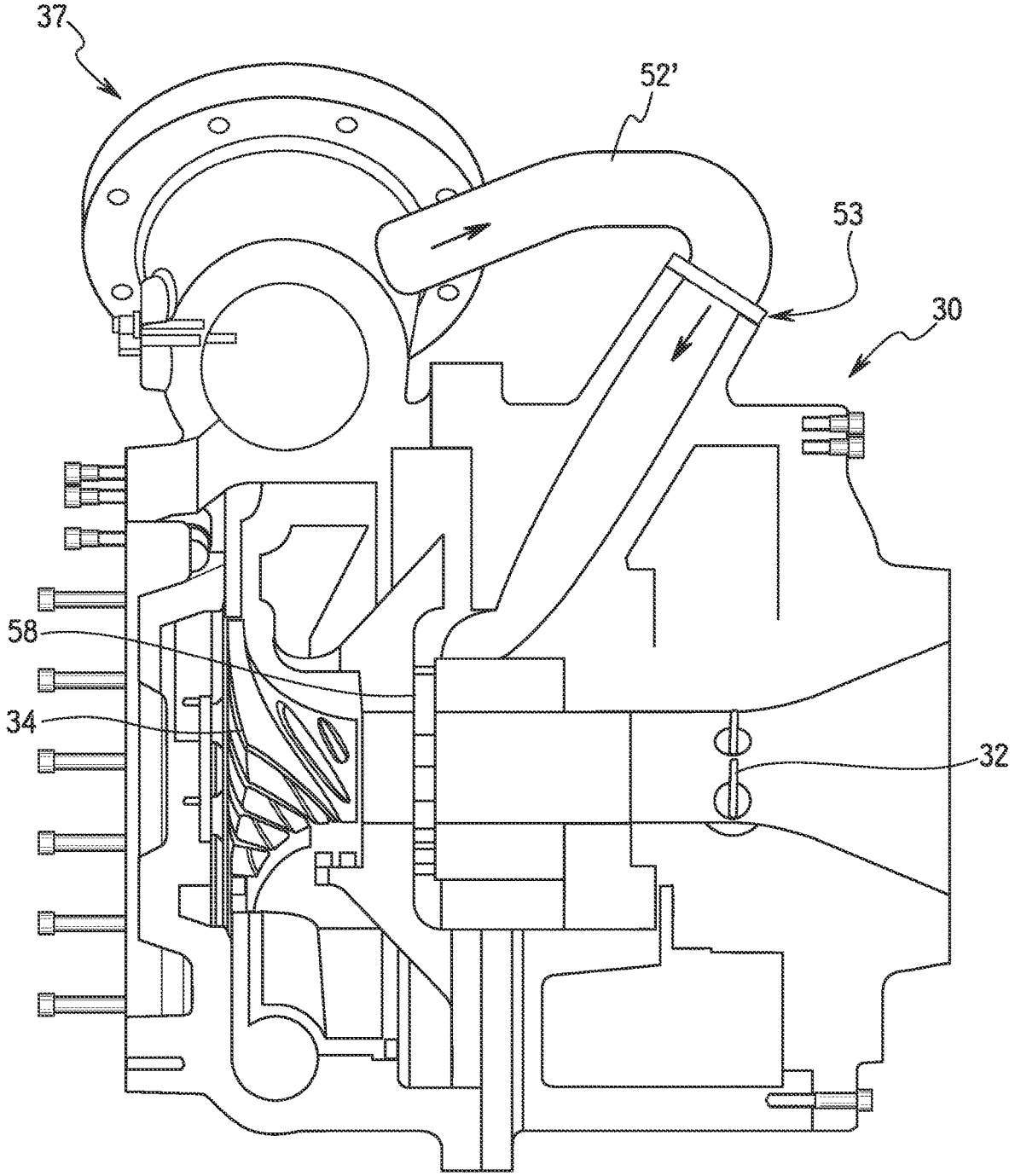
FIG. 16 is a simplified side view of the centrifugal compressor in accordance with a modified embodiment, with portions broken away and shown in cross-section for the purpose of illustration.

In the first embodiment, the recirculation pipe 52 of the recirculation structure 50 is disposed inside the casing 30 as illustrated in FIGS. 6 and 7. In a modified embodiment of the first embodiment, the recirculation pipe 52' is disposed outside the casing 30 as illustrated in FIG. 16. For example, the recirculation pipe 52' can be provided to extend from the discharge nozzle 37 of the compressor 22 toward the plurality of recirculation discharge guide vanes 56. The recirculation pipe 52' includes a valve 53 to adjust the flow of the refrigerant passing through the recirculation pipe 52. The valve is conventional, and thus, will not be discussed and/or illustrated in detail herein. Rather, it will be apparent to those skilled in the art that any suitable valve can be used without departing from the present invention. The modified embodiment can also apply to the second embodiment and the third embodiment as explained above.

In terms of global environment protection, use of new low GWP (Global Warming Potential) refrigerants such like R1233zd, R1234ze are considered for chiller systems. One example of the low global warming potential refrigerant is low pressure refrigerant in which the evaporation pressure is equal to or less than the atmospheric pressure. For example, low pressure refrigerant R1233zd is a candidate for centrifugal chiller applications because it is non-flammable, non-toxic, low cost, and has a high COP compared to other candidates such like R1234ze, which are current major refrigerant R134a alternatives. The compressor 22 having the recirculation structure 50 in accordance with the present invention is useful with any type of refrigerant including low pressure refrigerant such as R1233zd.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A centrifugal compressor adapted to be used in a chiller system, the centrifugal compressor comprising:

a casing having an inlet portion and an outlet portion;

a recirculation structure including a recirculation path and a recirculation discharge cavity;

an impeller disposed downstream of the recirculation discharge cavity, the impeller being attached to a shaft rotatable about a shaft rotation axis, the inlet portion extending axially to the impeller, the recirculation discharge cavity being separate from and radially surrounding the inlet portion;

a plurality of recirculation discharge guide vanes disposed to surround the recirculation discharge cavity, each of the plurality of recirculation discharge guide vanes being rotatable;

a motor arranged to rotate the shaft in order to rotate the impeller;

a diffuser disposed in the outlet portion downstream of the impeller, the recirculation structure configured to impart a swirl to a flow of refrigerant into the inlet portion, and the recirculation path supplying the refrigerant from the diffuser to the recirculation discharge cavity, and the recirculation path including a recirculation pipe that introduces the refrigerant toward the plurality of recirculation discharge guide vanes;

an annular groove disposed between the recirculation pipe and the plurality of recirculation discharge guide vanes; and an annular plate disposed between the annular groove and the recirculation discharge cavity.

2. The centrifugal compressor according to claim 1, wherein an angle of each of the plurality of recirculation discharge guide vanes is adjustable by rotating the plurality of recirculation discharge guide vanes.

3. The centrifugal compressor according to claim 2, wherein the plurality of recirculation discharge guide vanes are linked with one another so that the angles of the plurality of recirculation discharge guide vanes are adjusted simultaneously.

4. The centrifugal compressor according to claim 1, wherein the annular groove is provided in the casing to connect the plurality of recirculation discharge guide vanes and the recirculation pipe.

5. The centrifugal compressor according to claim 1, wherein at least a portion of the recirculation pipe is disposed inside the casing.

6. The centrifugal compressor according to claim 1, wherein a recirculation flow caused by the swirl of the refrigerant rotates in a same direction as a rotation direction of the impeller.

7. The centrifugal compressor according to claim 1, wherein a velocity of a recirculation flow caused by the swirl of the refrigerant is higher than a velocity of the flow of the refrigerant in the inlet portion.

8. The centrifugal compressor according to claim 1, wherein a recirculation flow caused by the swirl of the refrigerant rotates in an opposite direction to a rotation direction of the impeller.

9. A centrifugal compressor adapted to be used in a chiller system, the centrifugal compressor comprising:

a casing having an inlet portion and an outlet portion;

the inlet portion including an impeller;

the impeller having a shaft assembly;

a motor arranged to rotate the shaft assembly in order to rotate the impeller;

an outlet portion including a diffuser and a volute assembly;

a recirculation structure including a recirculation path, the recirculation path supplying a refrigerant from the diffuser to a recirculation discharge cavity, the recirculation path including a recirculation pipe that introduces the refrigerant toward the inlet portion;

a plurality of recirculation discharge guide vanes disposed to surround the recirculation discharge cavity;

an annular groove disposed between the recirculation pipe and the plurality of recirculation discharge guide vanes; and an annular plate disposed between the annular groove and the recirculation discharge cavity.

10. The centrifugal compressor according to claim 9, wherein the recirculation pipe extends from the diffuser toward the plurality of recirculation discharge guide vanes.

11. The centrifugal compressor according to claim 9, wherein the recirculation pipe includes a valve to adjust a flow of the refrigerant passing therethrough.

12. A centrifugal compressor comprising:

a casing having an inlet portion and an outlet portion;

an inlet guide vane disposed in the inlet portion;

a recirculation structure including a recirculation pipe and a recirculation discharge cavity;

an impeller attached to a shaft;

a motor arranged to rotate the shaft in order to rotate the impeller;

a plurality of recirculation discharge guide vanes;

an annular groove disposed between the recirculation pipe and the plurality of recirculation discharge guide vanes; and an annular plate disposed between the annular groove and the recirculation discharge cavity, the recirculation structure being configured and arranged to impart a swirl to a flow of refrigerant into the inlet portion, and the recirculation pipe being configured to flow the refrigerant toward the plurality of recirculation discharge guide vanes.

* * * * *